US006272301B1

(12) United States Patent
Kawada et al.

(10) Patent No.: US 6,272,301 B1
(45) Date of Patent: Aug. 7, 2001

(54) IMAGE FORMING APPARATUS FEATURING A ROTATABLE ELECTROCONDUCTIVE FOAM MEMBER

(75) Inventors: Masaya Kawada, Mishima; Toshiyuki Ehara, Yokohama; Harumi Ishiyama, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/401,772

(22) Filed: Sep. 22, 1999

(30) Foreign Application Priority Data

Sep. 22, 1998 (JP) ..... 10-285956

(51) Int. Cl.[7] ..... G03G 21/00; G03G 15/02
(52) U.S. Cl. ..... 399/148; 399/176; 399/357
(58) Field of Search ..... 399/148, 174, 399/176, 168, 357

(56) References Cited

U.S. PATENT DOCUMENTS

| | | | | |
|---|---|---|---|---|
| 4,457,615 | * | 7/1984 | Seanor | 399/148 |
| 4,469,435 | * | 9/1984 | Nosaki et al. | 399/148 |
| 5,587,774 | * | 12/1996 | Nagahara et al. | 399/176 |
| 6,023,597 | * | 2/2000 | Mayuzumi et al. | 399/176 |

FOREIGN PATENT DOCUMENTS

| | | |
|---|---|---|
| 54-83746 | 7/1979 | (JP) . |
| 57-46265 | 3/1982 | (JP) . |
| 57-115556 | 7/1982 | (JP) . |
| 57-158650 | 9/1982 | (JP) . |
| 59-111179 | 6/1984 | (JP) . |
| 59-133569 | 7/1984 | (JP) . |
| 60-67951 | 4/1985 | (JP) . |
| 60-95551 | 5/1985 | (JP) . |
| 60-168156 | 8/1985 | (JP) . |
| 60-35059 | 8/1985 | (JP) . |
| 60-178457 | 9/1985 | (JP) . |
| 60-225854 | 11/1985 | (JP) . |
| 61-100780 | 5/1986 | (JP) . |
| 61-231561 | 10/1986 | (JP) . |
| 62-168161 | 7/1987 | (JP) . |
| 62-278577 | 12/1987 | (JP) . |
| 63-208878 | 8/1988 | (JP) . |
| 63-254462 | 10/1988 | (JP) . |
| 64-34205 | 3/1989 | (JP) . |
| 2-64668 | 3/1990 | (JP) . |
| 2-38956 | 9/1990 | (JP) . |
| 4-134464 | 5/1992 | (JP) . |
| 5-249805 | 9/1993 | (JP) . |
| 6-194928 | 7/1994 | (JP) . |
| 7-101324 | 11/1995 | (JP) . |

* cited by examiner

*Primary Examiner*—Fred L. Braun
(74) *Attorney, Agent, or Firm*—Fitzpatrick, Cella, Harper & Scinto

(57) ABSTRACT

An image forming apparatus includes an image bearing member for bearing an electrostatic image; a developing device for developing the electrostatic image on the image bearing member with toner into a toner image; a transfer device for transferring the toner image onto a transfer material; a charging and cleaning device for removing residual toner after image transfer from the image bearing member and for charging the image bearing member; wherein the charging and cleaning device includes a rotatable member which has an electroconductive foam for retaining electroconductive particles and which is rotatable while rubbing the image bearing member.

9 Claims, 12 Drawing Sheets

IMAGE FORMING APPARATUS FEATURING A ROTATABLE ELECTROCONDUCTIVE FOAM MEMBER

FIELD OF THE INVENTION AND RELATED ART

The present invention relates to an image forming apparatus of an electrophotographic or electrostatic recording type copying machine, printer or the like, more particularly, to an image forming apparatus wherein a step of effecting both cleaning and charging is used.

Heretofore, an image forming apparatus using an electrophotographic type is provided with a rotatable electrophotographic photosensitive member in the form of a drum, for example, as an image bearing member substantially at the center thereof, and the surface of the electrophotographic photosensitive member is uniformly charged by charging means. Thereafter, the surface of the photosensitive member is exposed to a line scanning laser beam, so that the electrostatic latent image is formed in accordance with the image signal on the surface. The electrostatic latent image is visualized at a developing station where the surface of the photosensitive member is faced to a developing device with rotation of the photosensitive member, so that toner image is formed on the photosensitive member. Thereafter, the toner image is electrostatically transferred onto a transfer material by the transfer means, and the toner image is fixed by heat and pressure by a fixing device, so that a permanent image is formed on the transfer material. A cleaning means is provided at a predetermined position to remove untransferred toner from the photosensitive member after the image transfer, so that service of the photosensitive member is cleaned and is reused.

The image forming apparatus performing such a series of process steps, is widely used not only in copying machines but also in printers for outputting means of computers and word processors. The image forming apparatus is used not only in an office but also at home, and economical aspect such as being inexpensive or maintenance-free is important.

In an image forming apparatus having the above described structure, a corona charger is used as the charging means, and a metal wire having an outer diameter of approx. 50 $\mu$m–100 $\mu$m is supplied with a high voltage such as approx. 5 kV–10 kV, so that air therearound is ionized to electrically charge the member to be charged (photosensitive member for example).

However, the corona charger involves the following disadvantages.

The wire per se of the corona charger attracts contamination during the process of the charging operation, and therefore, periodical cleaning and exchange are required. The corona discharge produces ozone.

Recently, a surface hardness of the electrophotographic photosensitive member is increased to increase the printing durability. After repeated use of the photosensitive member surface, the high hardness photosensitive member becomes sensitive to humidity because of the influence of the product of the corona resulting form the ozone produced by the corona charger, with the result that the photosensitive member surface tends to absorb moisture, which causes lateral flow of the charge on the photosensitive member surface and therefore degrading of the image quality due to the resulting image flow.

To avoid these problems, Japanese Utility Model Application Publication No. HEI-1-34205 proposes heating by a heater for the photosensitive member; Japanese Patent Application Publication No. HEI-2-38956 proposes removal of the corona product by a brush formed by cooperation of a magnet roller and magnetic toner; and Japanese Laid-open Patent Application No. SHO-61-100780 proposes the removable of the corona product by an elastic roller from the photosensitive member surface.

However, although rubbing of the photosensitive member surface is used with an amorphous silicon photosensitive member having a very high hardness, the required cleaning device is bulky, against the recent demand for downsizing of the apparatus. Additionally, using the photosensitive member heater for always heating it results in an increase of the electric energy consumption.

The capacity of the heater for the photosensitive member is approx. 15 W–80 W, and the required energy is not so high, but in most of the cases, the energy is supplied always including the night time, the electric energy consumption amount is as large as 5–15% of the entire electric energy consumption of the image forming apparatus in a day.

The above mentioned Japanese Laid-open Patent Application No. SHO-59-111179 and Japanese Laid-open Patent Application No. SHO-62-278577 do not recognize the problem of instability of the name intensity due to the temperature variation of the photosensitive member.

Japanese Laid-open Patent Application No. SHO-63-208878 discloses a charging device of so-called contact charging type wherein a charging member supplied with a voltage is contacted to the surface of the member to be charged (photosensitive member, for example) to electrically charge the surface thereof. Such a charging device of the contact charging type is advantageous over the corona charger in that:

(1] the voltage required to provide the desired potential of the photosensitive member surface can be reduced:

(2) the amount of the ozone produced during the charging process is zero or extremely small, so that necessity of using an ozone removal filter is eliminated, and therefore, the exhausting system of the main assembly of the image forming apparatus can be simplified.

Therefore, the above described drawbacks resulting from the production of ozone and ozone derivative can be avoided.

Therefore, the charging device of the contact charging type is expected as the means replaceable with the corona charger to electrically charge the member to be charged such as a photosensitive member or a dielectric member in an image forming apparatus such as a copying machine, a laser beam printer or an electrostatic recording apparatus.

The following contact charging member usable with the contact charging type charging device have been proposed:

A contact charging member in the form of a magnetic brush of magnetic particles and magnetic materials, as disclosed in Japanese Laid-open Patent Application No. SHO-59-133569:

A contact charging member of a fur brush including electroconductive fibers, as disclosed in Japanese Laid-Open Patent Application No. SHO-57-046265:

A contact charging member in the form of an elastic roller of elastic materials including electroconductive sponge.

FIG. 14 shows a schematic structure of an example of a conventional image forming apparatus using the contact charging type. A electrophotographic photosensitive member 3 (photosensitive member) in the form of a drum is rotated at a predetermined peripheral speed (process speed)

in the direction indicated by an arrow x, and the surface thereof is contacted by a charging member 5 which is a contact charging member.

The charging member 5 is supplied by voltage applying means (unshown) with a DC voltage (Vdc) alone or with a DC voltage (Vdc) biased with an AC voltage (Vac), and uniformly charges the outer surface of the photosensitive member 3 which is rotating in the direction indicated by the arrow.

On the other hand, an original G placed on an original supporting platen glass 6 is illustrated with light L emitted by a lamp 71 (exposure means 7), and the light reflected by the original G is imaged through a mirror system 72 by an imaging lens of a lens unit 73, and is directed to the surface of the photosensitive member 3 through a mirror 74, so that image of the original is formed on the surface of the photosensitive member 3, or the surface of the photosensitive member 3 is scanned by a line scanning laser beam which is modulated in its intensity in accordance with an image signal, so that an electrostatic latent image is formed on the photosensitive member 3.

The electrostatic latent image is carried to a developing position where the surface thereof is opposed to a developing device 3, by rotation of the photosensitive member 3, and the electrostatic latent image is visualized by a developing sleeve 81 coated with a developer charged to proper polarity, so that toner image is formed on the photosensitive member 3. Thereafter, the toner image on the photosensitive member 3 is electrostatically transferred onto a transfer material P by transferring means 10, and the unfixed toner image on the transfer material P is fixed by heat and pressure, and then, the transfer material P is discharged to outside of the image forming apparatus.

The untransferred toner or the like remaining on the photosensitive member 3 after the transfer of the toner image onto the transfer material P, reaches the position where the photosensitive member is opposed to a cleaning device 6, and is removed from the photosensitive member 3 by scraping or rubbing with a cleaning member in the form of a magnetic brush, fur brush, cleaning roller 61 and/or a cleaning blade 62. The electrostatic latent image remaining on the photosensitive member 3 is erased by light provided by a discharging light source 13.

When use is made of a magnetic brush has the charging member 5, a magnetic brush layer of magnetic particles is formed on the surface of a cylindrical sleeve containing therein a multipole magnetic member or a magnetic member of ferrite magnet, rubber or magnet.

The examples of the magnetic particles include magnetic oxide of iron (ferrite) powder such as Cu—Zn—Fe—O particles, magnetite powder, resin material in which ferrite, magnetite or other magnetic material id dispersed, or known magnetic toner material.

When the fur brush is used as the charging member 5, a fur brush layer including electroconductive fibers is formed on a core metal of an electroconductive member such as a metal material.

The electroconductive fiber is usually of vinyl, PET, polystyrene or like resin fibers in which carbon is dispersed.

When use is made of an elastic roller as the charging member 5, the charging member 5 comprises a supporting shaft and a sponge layer of urethane foam or the like which has been treated for electroconductivity.

In any case, the resistance value of the charging member 5 is selected in consideration of the ambient conditions under which it is used, the voltage resistance of the surface layer of the photosensitive member 3 which is the member to be charged, so as to provide high charging efficiency.

In the image forming apparatus shown in FIG. 14, the charging step using the charging member and the cleaning step using the cleaning member, are provided as separate steps. A proposal has been made in which contact charging member is used to effect the charging and cleaning for the member to be charged, simultaneously.

Japanese Laid-open Patent Application No. HEI-2-064668 discloses an image forming apparatus comprising a charging and cleaning member (charging member), and Japanese Laid-open Patent Application No. HEI-4-134464 discloses an image forming apparatus comprising a CLN charging member using a magnetic brush.

In the case of using such a charging member, too, the electrostatic latent image formation, visualization on the photosensitive member 3 and the transfer of the toner image onto the transfer material, are carried out (FIG. 14). Thereafter, the untransferred toner or the like on the photosensitive member 3 is removed by CLN in the form of a magnetic brush or a fur brush in the cleaning apparatus 6. The roller 61 is supplied with a high-voltage from voltage applying means (unshown) to uniformly charge the surface of the photosensitive member 3. In this case, no charging member 5 is provided in addition to the cleaning member. The charging and cleaning mechanism is advantageous from the standpoint of an ozoneless nature and a downsizing of the image forming apparatus.

A description will be made as to an electrophotographic photosensitive member (photosensitive member) used as an image bearing member.

One of the known electrophotographic photosensitive member is an organic photoconductor (OPC). Recently, various organic photoconductor materials have been developed as photoconductive materials for a photosensitive member, and particularly, a so-called functionally-separated type photosensitive member having a layered structure comprising a charge generating layer and a charge transfer layer, have already been used in commercial copying machines and laser beam printers. However, such a photosensitive member has a drawback that its durability is relatively low.

The durability of the photosensitive member includes a durability in the electrophotographic property such as a sensitivity, residual potential, charging power or image blurrness, and a mechanical durability against sliding, wearing scraping of the photosensitive member surface, and the durability are significant factors relating to the lifetime of the photosensitive member.

Among the durabilities, those relating to the electrophotographic property particularly, image blurriness is caused by deterioration of the charge transportation substance contained in the surface layer of the photosensitive member due to an active substance such as ozone or NOx produced by the corona charger.

The mechanical durability concerns the physical contact and rubbing of the photosensitive layer by paper, a blade and/or cleaning member (roller).

In order to improve the durability in the electrophotographic property, it is preferable to use a charge transportation substance which is not easily deteriorated by an active substance such as ozone or NOx, more particularly, use of a charge transportation substance having a high oxidation potential. In order to improve the mechanical durability, it is preferable to reduce the friction by enhancing a lubricity of the surface or to enhance the parting property of the surface to prevent fusion of the toner, so that surface is durable against the rubbing of the paper and/or the cleaning member. Therefore, it is known that the surface layer comprises a lubricant such as fluorine resin material powder, graphite fluoride or polyolefin resin powder.

However, when the wearing of the photosensitive member surface is significantly reduced, an absorptive material produced by the active substance such as ozone or NOx is deposited on the photosensitive member surface, and as a result, the surface resistance lowers such that surface charge moves laterally with a result of so-called absorptive material image flow.

As another photosensitive member, an amorphous silicon photosensitive member (a-Si photosensitive member) is known. The photoconductive material constituting the photosensitive layer of the photosensitive member in the electrophotographic desirably has the following characteristics: that sensitivity is high within high SN ratio (photo-current (Ip)/dark current (Id)): it has an absorption spectrum matching the spectrum property of the electromagnetic radiation projected thereto: the light responsivity is quick with a desirable dark resistance value. In the case of office use in which a great amount of image formations are carried out for long term, the long term stability of the image quality and the image density is also important.

For example of such a photoconductive material is amorphous hydride (a-Si:H), which is described in Japanese Patent Application Publication No. SHO-60-35059 wherein it is used as a photosensitive member for an image forming apparatus.

Such a photosensitive member for the image forming apparatus is manufactured by heating an electroconductive supporting member to 50° C.–400° C., forming on the supporting member a photoconductive layer of a-Si through a film formation method such as vacuum deposition method, sputtering, ion plating, heat CVD, light CVD, CVD or the like. Among these methods, the plasma CVD method has been put into practice, wherein a source material gas is dissolved by DC, high frequency or microwave glow discharge, and the a-Si accumulated film is formed on the supporting member.

In Japanese Laid-open Patent Application No. SHO-54-83746, there is proposed the photosensitive member for an image forming apparatus, comprising an electroconductive supporting member and a photoconductive layer of a-Si (a-Si:X) comprising halogen atoms.

In the publication, the a-Si comprises 1–40 atomic % of halogen atoms, by which the heat-resistivity is enhanced, and the electrical and optical properties suitable for a photoconductive layer of the photosensitive member for the image forming apparatus.

Japanese Laid-open Patent Application No. SHO-57-115556 discloses a provision of a surface barrier layer of nonphotoconductive amorphous material comprising silicon atom and carbon atoms on a photoconductive layer of amorphous material comprising silicon atoms as a base material in order to improve the electrical optical and photoconductive properties such as a dark resistance value, a photosensitivity, a light responsivity of the photoconductive member having the photoconductive layer formed by a-Si accumulated film, and in order to improve the usability such as moisture resistance and stability with time.

Japanese Laid-open Patent Application No. SHO-60-67951 discloses a photosensitive member having a transparent and insulative coating layer comprising amorphous silicon, carbon, oxygen and fluorine, and Japanese Laid-open Patent Application No. SHO-62-168616 discloses a use, as a surface layer, of amorphous material comprising silicon atom, carbon atoms and 41–70 atomic % hydrogen atoms.

Japanese Laid-open Patent Application No. SHO-57-158650 discourses a photosensitive member for image forming apparatus, having a high sensitivity and a high resistance by the use of the a-Si:H, for the photoconductive layer, which comprises 10–40 atomic % of hydrogen and which has 0.2–1.7 of absorption coefficient ratio of the absorption peak of the infrared absorption spectrum 2100 $cm^{-1}$ and 2000 $cm^{-1}$.

On the other hand, Japanese Laid-open Patent Application No. SHO-60-95551 discloses that in order to improve the image quality of the a-Si, the temperature adjacent the photosensitive member surface is maintained at 30–40° C., by which the lowering of the surface resistance due to the moisture adhesion on the photosensitive member surface occurring as a result of charging, exposure, development and transfer operations for image formation, and the resulting image flow, are prevented.

Because of these developments, the electrical, optical and photoconductive property and the usability of the photosensitive member for the image forming apparatus have been improved, and therefore, the image quality has been improved.

It is known that heat source is a provided inside such a photosensitive member for the image forming apparatus in order to prevent and remove the image flow under the high humidity condition, and usually, a flat or rod electric heater is disposed inside the cylindrical photosensitive member.

The image forming apparatus using the contact charging member or the image forming apparatus using the charging and cleaning member is advantageous as described in the foregoing, but it involves the following problems.

In the case that charging member (CLN charging member) has a magnetic brush which is supplied with the voltage, that is, magnetic particles are used to charge the member to be charged (photosensitive member, for example), a liability of leakage of the magnetic particles is a problem.

This problem concerns a balance among the magnetic attraction force between the magnetic member and the magnetic particles constituting the magnetic brush layer, the mechanical force such as friction due to the reaction of the photosensitive member which is in the form of a drum, and the Coulomb force of the electric field resulting from the potential difference between the magnetic brush layer and the noncharged portion on the photosensitive member surface.

Particularly, when, for example, the rotational speed of the photosensitive member, the relative speed relative to the charging member, a potential difference between the charged potential Vp applied and the photosensitive member surface before charging, is large, the magnetic particles constituting the magnetic brush layer may move to the surface of the photosensitive member which is rotating, during the charging process of the like. If this occurs, the charging efficiency lowers with the result of unintended density difference of the image. Japanese Laid-open Patent Application No. HEI-06-194928 discloses a magnetic susceptivility and the particle size of the magnetic particles to provide magnetic attraction force by use of a multipole magnetic member.

Japanese Laid-open Patent Application No. SHO-63-254462 discloses that SnO2 is dispersed in the resin material of the surface layer, and a preferable diameter of the SnO2 and surface roughness of the surface layer. However, an effective contact area between the magnetic particles and the photosensitive member or the effects thereof on the charging efficiency or the durability are not recognized.

When the contract between the photosensitive member and the magnetic particles is not sufficient, they are locally noncontacted with the result of partial or wide range improper charging.

Particularly, in the image forming apparatus using a photosensitive member having a very low service life with the high-speed operation (a-Si photosensitive member, for example), the image quality is degraded due to a decrease of the magnetic particles and the nonuniform charging, and therefore, maintenance or exchange of the charging member is inevitable. These increase servicing cost against the tendency to be maintenance-free.

In order to prevent reduction of the magnetic particles, it would be considered to use magnetic particles having a large magnetic particle diameter, but then, non-contact areas between the magnetic particles and the photosensitive member increase with the result of uneven stripes in the image to the improper charging after the noncontact areas.

Another method would be to use a recapturing mechanism or to use a plurality of charging members to stepwisely charge the photosensitive member, but these are disadvantageous in terms of downsizing and cost reduction of the image forming apparatus.

When the contact charging member (including CLN charging member) comprises a fur brush of electroconductive fibers, the sizes of the fibers and the strength thereof would be problems.

Generally, the fibers constituting the fur brush have cross-sectional areas and lengths which are both much larger than those of the pixel in the electrophotographic, and the fiber planting density and the configuration of the fur brush are significantly influential to the image quality.

In the system using the fur brush, the relative speed between the fur brush and the photosensitive member is made larger than when the magnetic brush is used so that vibration or the rotation is used to improve the image quality.

However, then, a high speed driving mechanism is required, and the fibers may come out, which would result in improper charging. If the cross-sectional area of the fiber is small, it easily deforms, so that charging efficiency changes in long term use.

Thick fibers are used in an attempt to prevent such deformation, the image quality is deteriorated as with the case of the large size magnetic particles, and in addition, cleaning would be difficult.

When an excessive current flows due to fine defects on the surface of the member to be charged (photosensitive member, for example), the fibers would burn at the position. At such position, the change of the state of contact with the member to be charged and therefore improper charging always occur.

In the case that contact charging member (including CLN charging member) comprises an elastic roller, the roller and/or the member to be charged is damaged due to the friction if a relative speed is provided between the roller and the member to be charged (photosensitive member for example). If the contact is made closer in an attempt to improve the image quality, friction increases, and the influence of the collapse with the projections of the photosensitive member and/or the foreign matter. If this occurs, the elastic roller and/or the photosensitive member tends to be damaged.

SUMMARY OF THE INVENTION

Accordingly, it is a principal object of the present invention to provide an image forming apparatus with which ozone is substantially not produced.

It is another object of the present invention to provide an image forming apparatus wherein charging and cleaning are carried out in one step.

According to an aspect of the present invention, there is provided an image forming apparatus comprising: an image bearing member for bearing an electrostatic image; developing means for developing the electrostatic image on said image bearing member with toner into a toner image; transfer means for transferring the toner image onto a transfer material; charging and cleaning means for removing residual toner after image transfer from said image bearing member and for charging said image bearing member; wherein said charging and cleaning means includes a rotatable member which has an electroconductive foam for retaining electroconductive particles and which is rotatable while rubbing with said image bearing member.

These and other objects, features and advantages of the present invention will become more apparent upon a consideration of the following description of the preferred embodiment of the present invention taken in conjunction with the accompanying drawings.

DESCRIPTION OF THE PREFERRED EMBODIMENTS

Referring to the accompanying drawings, an image forming apparatus according to an embodiment of the present invention will be described.

(Embodiment 1)

Figure 1:
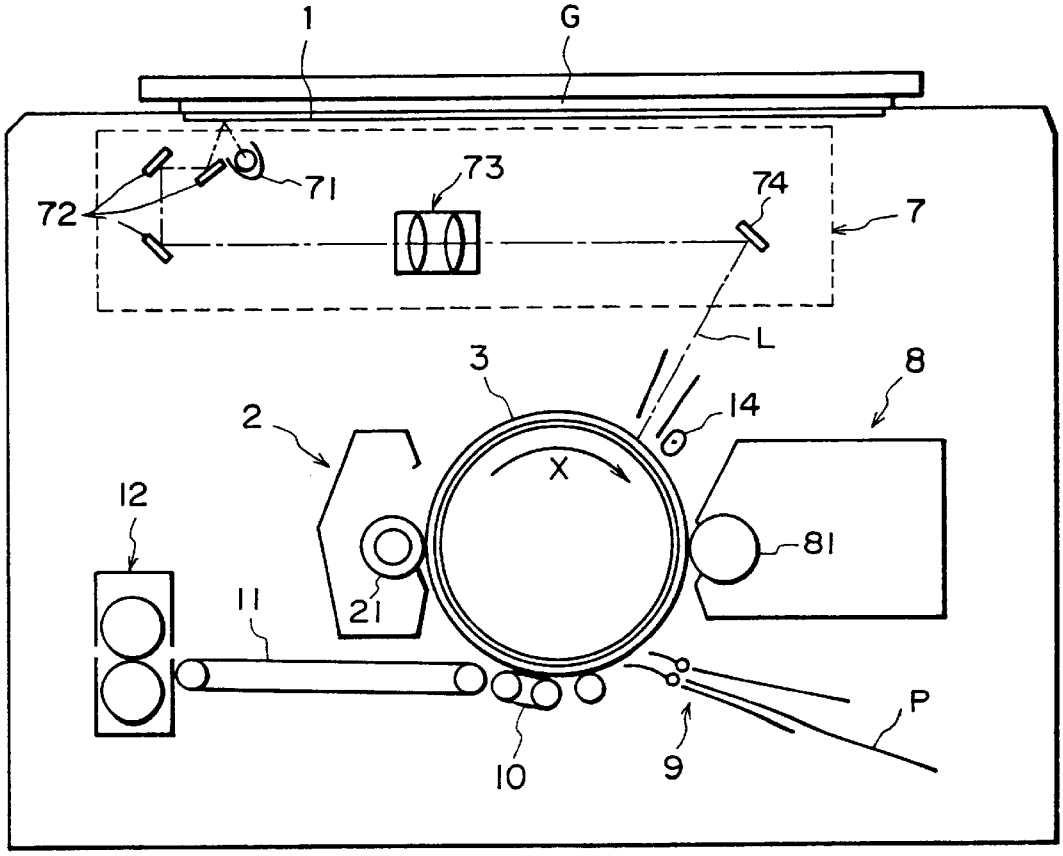
FIG. 1 is a schematic illustration of an image forming apparatus according to an embodiment of the present invention.

FIG. 1 shows a schematic structure of an image forming apparatus according to one embodiment of the present invention. In this embodiment, the image forming apparatus is an electrophotographic type copying machine, but the present invention not limited to it, and is applicable to a laser beam printer, facsimile machine or like, for example.

In the copying machine in this environment, an electrophotographic photosensitive member 3 in the form of a drum as an image bearing member is rotated in the direction of arrow X at a predetermined peripheral speed (process speed), and to the surface of the electrophotographic photosensitive member 3, a charging under cleaning member (CLN charging member) 21 of a charging and cleaning device 2 is contacted.

The CLN charging member 21 is supplied with a DC voltage (Vdc) or a voltage (Vdc+Vac) biased with an AC voltage (Vac) from voltage applying means (unshown).

On the other hand, a lamp 71 emits light which is reflected by an original a placed on an original supporting platen glass 1 and is imaged by an imaging lens of a lens unit 73 by way of a mirror system 72, and the image is projected on the surface of the photosensitive member 3 so that electrostatic latent image is formed on the photosensitive member 3.

Thereafter, the electrostatic latent image is carried on the rotating photosensitive member 3 to a developing position where the surface of the photosensitive member 3 is opposed to a developing device 3, and is visualized by developer including toner and charged to a proper polarity on a developing sleeve 81, so that toner image is formed on the surface of the photosensitive member 3. Thereafter, the toner image on the photosensitive member 3 is electrostatically transferred onto a transfer material P by transferring means 10 in the form of a roller or a belt, and then, the unfixed toner image on the transfer material P is fixed by heat and pressure, and the transfer material P is discharged to outside of the image forming apparatus.

After the transfer of the toner image onto the transfer material P, the untransferred toner remaining on the surface of the photosensitive member 3 is removed therefrom by a CLN charging member 21 of a charging and cleaning device 2.

A description will now be made as to the CLN charging member.

Figure 2:
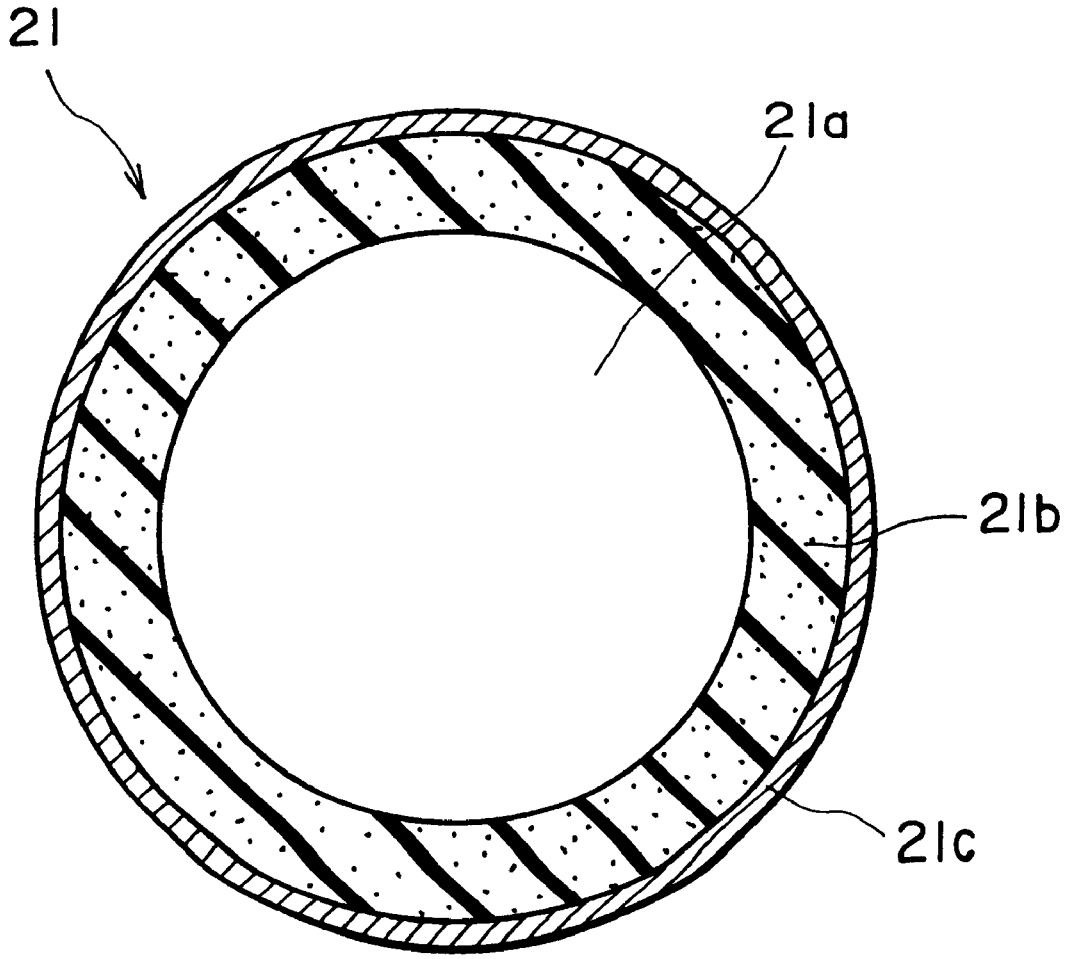
FIG. 2 is a schematic sectional view of a CLN charging member according to an embodiment of the present invention.

FIG. 2 schematically shows a cross-section of the CLN charging member 21.

According to this embodiment, the CLN charging member 21 is in the form of a roller, and comprises a core metal 21*a,* a sponge layer 21*b* and an applied particle layer 21*c* (fine charging performance enhancing particles)applied on the outer surface thereof. The charging member 21 is supplied with a DC voltage Vdc or a voltage Vdct+Vac biased with an AC voltage from voltage applying means (unshown) by way of the core metal 21*a,* or directly to the sponge layer 21*b* by which the electric charge is directly injected into the surface of the photosensitive member after the contact portion with the surface of the photosensitive member 3, by which the surface of the photosensitive member 3 is uniformly charged electrically.

The core metal 21*a* is of electroconductive structure material such as metal, and is designed properly by one skilled in the art in consideration of the process speed and other conditions under which it is used. The sponge layer 21*b* is of an electroconductive material having a controlled resistance, and the part thereof adjacent the outermost part is porous. The pore size thereof is preferably not more than 500 $\mu$m from the standpoint of the uniformity of the contact. The depth of the pore is such that particles are retained in the pores and preferably such that when the cleaning and the charging of the member to be charged are carried out, the pores are filled with the charging-promotion particles so that pore portions and the nonpore portions are substantially flush with each other. From this standpoint, it is preferable that pore size is the equivalent to or larger than the radius of the charging-promotion particles.

A proper flowability on the surface of the sponge layer 21*b* is preferable in view of the increase/decrease of the particles such as toner.

More specifically, the diameter of pores of the sponge layer 21*b* is preferably several $\mu$m–500 $\mu$m.

The depth of the pores is preferably not less than the radius of the particles. If the depth is too large, the mechanical strength or durability is degraded. In view of the flowability of the particles, too, it is preferable that there be no more than approx. 2 mm.

The cleaning and charging member 21 can take the residual toner on the photosensitive member by damming and rubbing in the cleaning, and the particles such as toner particles can be retained by the surface structure thereof, so that it is usable irrespective of the magnetic property, dielectric constant, electrostatic charging property or the like. Furthermore, the moving direction of the CLN charging member 21 is not limited. For example, when the CLN charging member 21 is in the form of a roller, any rotational direction is usable.

In an example of manufacturing the CLN charging member 21, EPDM or the like in which electroconductive material is dispersed is foamed and molded on a core metal 21*a,* and is abraded to a predetermined dimension. Or, the material may be molded into a pile, and then it is wrapped on the core metal. Examples of the electroconductive material include carbon black or Ketjenblack.

The thickness, rubber hardness or the like of the sponge layer 21*b,* can be properly selected in accordance with the conditions such as the process speed (peripheral speed of the photosensitive member 3), the relative speed or the like under which the apparatus is operated.

If the hardness of the sponge layer 21*b* of the CLN charging member 21 is low, the damage of the CLN charging member 21 per se and the surface of the photosenstive member 3 due to the contact and rubbing with the particles such as the toner can be prevented. Additionally, a large nip width is sable under low load. Moreover, charging noise when the AC voltage bias is employed.

On the other hand, high hardness of the sponge layer 21 is advantageous in the resistance against deformation, that is, durability. Additionally, the strength of the pits and projections can be assured so that toner once captured can be retained.

Therefore, the hardness of the sponge layer 21*b* is preferably adjusted to be within such a range that particles such as untransferred toner which has been captured on the surface can be retained, and that deformation or the like does not occur. Moreover, e relatively low hardness is preferable within such a range.

More specifically, the preferable hardness is 15–70° approx. (Asker-C hardness). When the voltage applied to the charging member contains AC component, soft CLN charging member 21 having an ASCER-C hardness 60° or lower is preferable (Japanese Laid-open Patent Application Ho. HEI-5-249805, Japanese Patent Application Publication No. HEI-7-101324 and so on). In terms of the durability, 20–60° approx. is preferable.

The selection of the hardness should be made also in consideration of the hardness of the photosensitive member 3 used. More specifically, it is selected in consideration of the process speed and the intended service life of the image forming apparatus.

The hardness of the sponge layer 21*b* changes depending on the content of the electroconductive material and the composition thereof. Additionally, by adjusting the bubbles, the size and the quantity of the pores in the sponge layer 21*h,* the hardness can be adjusted.

The resistance of the sponge layer 21*b* preferably has a resistivity of $1\times10^{3}$–$1\times10^{12}$ Ωcm in order to maintain high charging efficiency and also to prevent leakage spots or to prevent lowering of the potential along the longitudinal direction of the charging member due to fine defects on the surface of the photosensitive member 3. More specifically, it is preferably $1\times10^{5}$—$1\times10^{9}$ Ωcm.

Here, the resistance value is measured in this manner: a metal tape having a width of is wound around the surface of the CLN charging member 21 to be measured, and the resistance value is detected using MΩ tester available from HIOKI, Japan while 50–1000 V is being applied.

As described in the foregoing, the CLN charging member 21 of this embodiment is capable of retaining the charging-promotion particles applied on the outermost surface portion thereof as will be described hereinafter, the untransferred toner removed from the photosensitive member 3 by the cleaning operation, by the surface structure per se of the charging member, and therefore, the leakage of the particles which tends to occur when magnetic brush is used.

As regards the contact to the surface of the photosensitive member 3, a very close contact is accomplished as contrasted to the case of the fur brush, and therefore, the nonuniformity can be avoided both in the cleaning and the charging actions.

Moreover, since the particles such as the charging-promotion particles or the toner particles exist between the CLN charging member 21 and the photosensitive member 3, the contact property is better than in the case that when the CLN charging member 21 alone is used, and therefore, uniform charging is accomplished. In addition, the friction between the CLN charging member and the member to be charged (photosensitive member 3) is reduced by the flowing mobility of the particles, so that damage of the CLN charging member 21 and the photosensitive member 3 can be suppressed.

It is preferable that predetermined gap is provided between the CLN charging member and the photosensitive member 3 by rollers, spacers or the like in order to stably control the width of contact between the photosensitive member 3 and the CLN charging member 21. It is also preferable that CLN charging member 21 rotates, moves and/or vibrates with a proper relative speed in the direction of the peripheral movement (X). In this case, it is not preferable that CLN charging member 21 is driven by the photosensitive member 3. That is, in order to remove the untransferred toner or the like and in order to prevent improper charging attributable to the microscopical nonsmoothing of contact, a predetermined relative speed is preferably provided.

In this environment, the CLN charging member 21 is in the form of a roller, to which the present invention is not limited, and may be a belt or the like.

In this environment, the member to be charged (image bearing member) is in the form of a drum, but the present invention is not limited to that.

A description will now be made as to particles applied on the sponge layer 21*b* of the charging member 21 in this environment.

The application of the charging-promotion particles on the surface of the CLN charging member 21 is effective to improve uniformity of contact between the CLN charging member 21 and the photosensitive member 3, thus promoting the charging reaction and to improve lubricity.

The particles applied on the surface of the CLN charging member 21 may be magnetic or nonmagnetic. The particle size of the particles are properly selected depending on the sizes of the pores of the sponge and on the particles size of the used toner or the like. From the standpoint of the image quality such as contact property, cleaning cleaning, charging property or the like, the particles preferably have the same particle size as the toner contained in the developer accommodated in the developing device 8, or have a smaller particle size than that. The particle size is of the charging-promotion particles may be uniform or may contain charging-promotion particles having different particle sizes in order to improve the flowability.

As regards the particle sizes of the charging-promotion particles and the toner particles, the peaks are measured using a laser diffraction type particle size distribution measuring device HEROS available from Nippon Denshi KABUSHIKI KAISHA, Japan, for a range of 0.05 μm–200 μm with 32 parts logarithm division, and the average particle size is determined as 50% average particle size. The average particle size of the entire charging-promotion particles may be determined by extracting not less than 100 particles at random and determining the maximum chord length in the horizontal direction as the average particle size using an optical microscope or scanning electron microscope.

Preferably, the electroconductivity of the charging-promotion particles is adjusted similarly to the sponge layer 21*b,* and for this purpose, use may be made of Zn0. The particles may be toner particles used as a one component developer or carrier particles used in a two component developer, or further may be untransferred toner particles caught in the cleaning step.

As described in the foregoing, by using the porous CLN charging member 21 having a controlled resistance and configuration in accordance with the present invention and the charging-promotion particles applied on the surface thereof, the microscopical contact between the cLN charging member 21 including the charging-promotion particle and the photosensitive member 3 can be optimized, so that degradation of the image quality attributable to the improper charging can be avoided.

In the image forming apparatus using pre-exposure and particularly using an amorphous silicon photosenstive member (a-Si1 photosensitive member), a large current such as several 10 $\mu$A/cm$^2$ (several 100 $\mu$A, total current) flows from the CLN charging member 21 supplied with the voltage to the photosensitive member 3. At that time, in the contact nip between the CLN charging member 21 and the photosensitive member 3, the contact area between the CLN charging member 21 and the photosensitive member 3 is large so that microscopical movement of the charge is smooth. In addition, by the stirring of the particles due to the existence of the unsmoothness on the surface of the CLN charging member 21 in the contact nip, so that nonuniformity of charging can be prevented.

The charging-promotion particles applied on the surface of the CLN charging member 21 are retained by the mechanical unsmoothness structure of the CLN charging member 21, so that leakage of the particles due to the motion of the particles toward the surface of the photosensitive member 3 while keeping the electric charge.

Additionally, the liability of the mechanical damage of the surface of the photosensitive member 3 and/or the CLN charging member 21 is reduced, and therefore, the required maintenance operation is reduced, and the service life of the image forming apparatus is expanded.

By using a mechanism for removing or supplying charging-promotion particle, the period of service maintenance operations for the exchange of the particles can be expanded even to the extent that maintenance operation is not necessary.

Moreover, a wider latitude can be provided for design modification of the image forming apparatus such as modification of the process speed, the charging of the surface of the photosensitive member or the like, or the modification of the durability of the photosensitive member.

A description now will be made as to the electrophotographic photosensitive member (photosensitive member)3 in the present invention.

The photosensitive member 3 as the image bearing member (member to be charged) to be charged by the CLN charging member 21 according to the present invention, may be a conventional photosenstive member, or preferably, a new photosensitive member.

According to the present invention, the resistance value of the surface layer of the photosensitive member 3 is controlled such that proper characteristics can be maintained.

Figure 9:
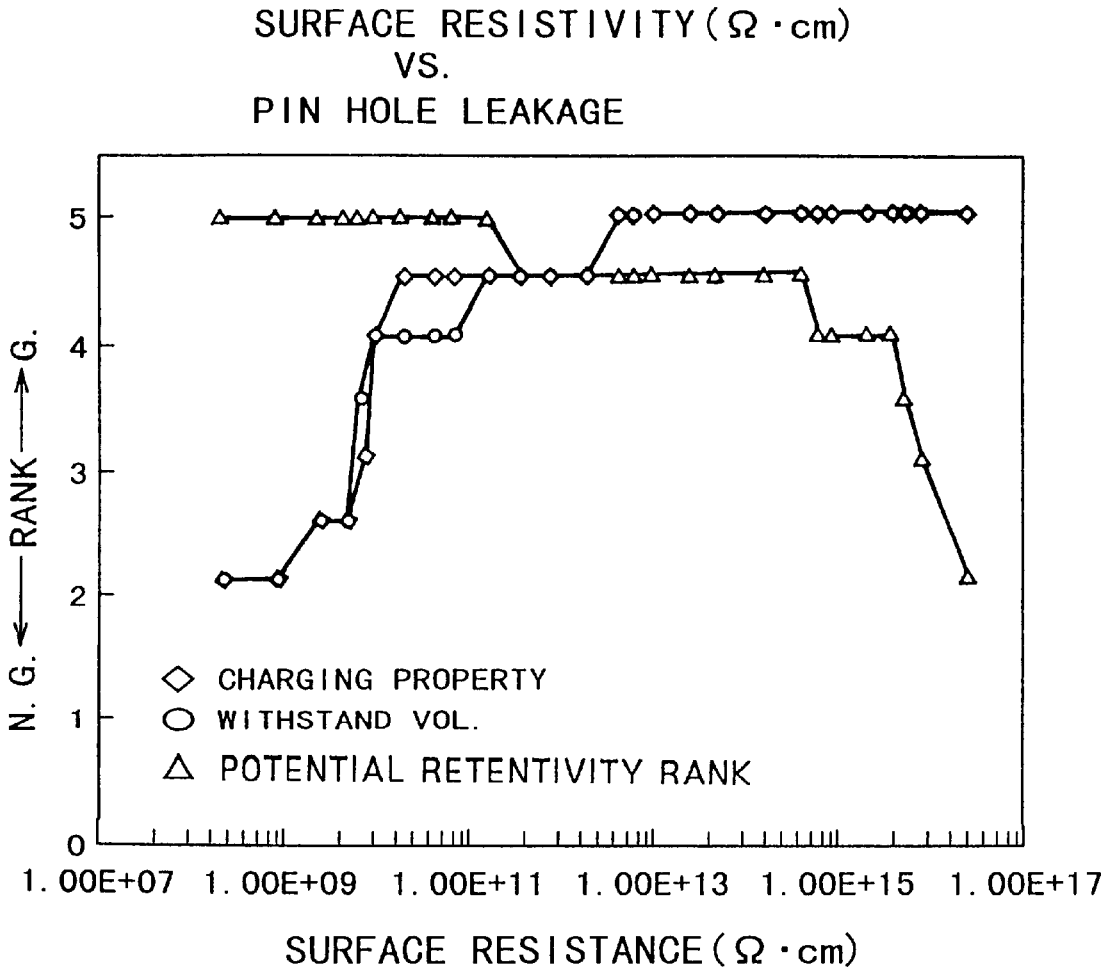
FIG. 9 is a graph showing the relationship between the resistance value of the surface layer of the photosensitive member and the charging efficiency according to an embodiment of the present invention.

FIG. 9 shows a relationship between the resistance of the surface layer of the photosensitive member 3 and a charging property, potential retentivity, withstand voltage of the photosensitive member 3 having the surface layer.

The resistance value of the surface layer of the photosensitive member 3 is measured using a MΩ tester available from HIOKI, Japan, while applying a voltage of 250v–1kV. As shown in FIG. 9, it is preferable that resistivity is $1\times10^{10}$–$5\times10^{15}$ Ωcm from the sandpoint of providing good electrical property such as charge retentivity or charging efficiency of the photosensitive member 3 preventing pin hole leakage which causes damage of the surface layer by the voltage. Further preferably, it is $1\times10^{12}$–$1\times10^{14}$ Ωcm.

It has been found that in addition to the above conditions, when the photosensitive member 3 has a low temperature dependence and high surface durability, the stable image formation can be maintained for a long term.

Another means for solution to the above-described problem is the provision of the surface layer of the electroconductive fine particles dispersed in a binder resin material, the electric charge is directly injected to the electronic level of the surface (outermost) layer from the CLN charging member 21, by which good images can be stably provided.

The description will be made as to the organic photocondutor (OPC) as the photosensitive member 3.

FIG. 3 is a schematic view of a layer structure of a photosensitive member for an image forming apparatus according to an embodiment of the present invention.

Figure 3A:
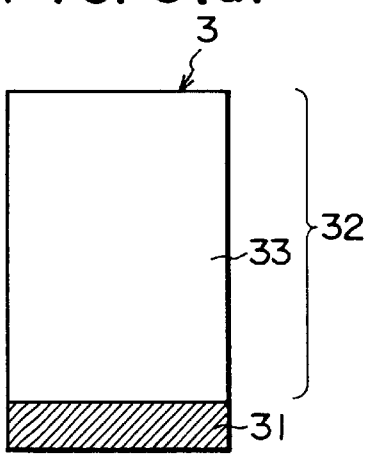
FIG. 3 is a schematic sectional view illustrating a layer structure of an electrophotographic photosensitive member.
Figure 3B:
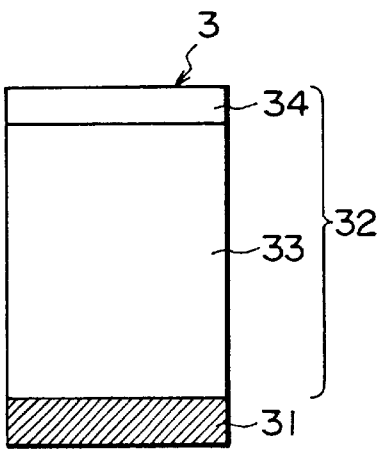
Figure 3C:
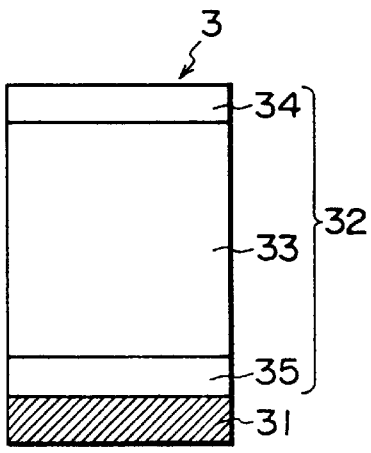
Figure 3D:
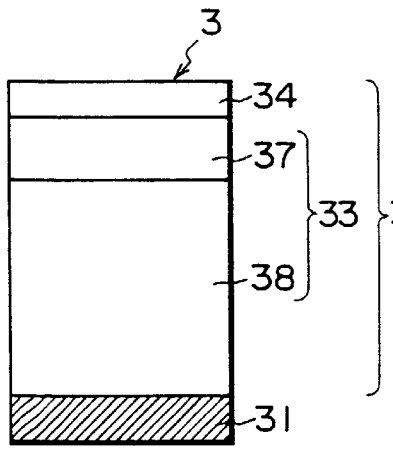
Figure 3E:
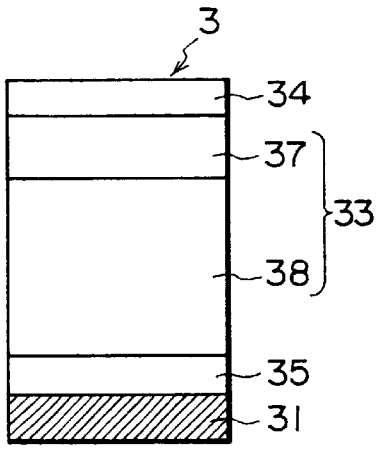
Figure 3F:
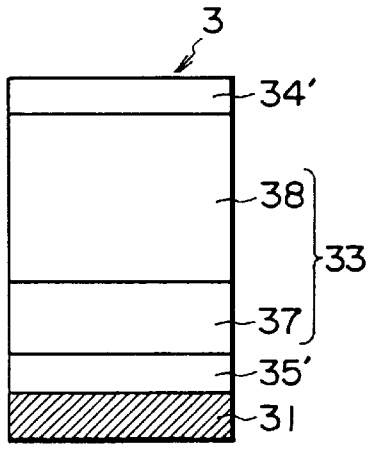

FIG. 3(f) shows an example of an OPC photosensitive member for an image forming apparatus. In this embodiment, the OPC photosensitive member 3 ln the form of a drum comprises a supporting member 31, a photosensitive layer (light receiving layer) 32. The photosensitive layer 32 includes a photoconductive layer 33 having a charge generating layer 37 and a charge transfer layer 38, and if necessary, a surface protection layer or a surface layer, and there is provided an intermediate layer between the supporting member 31 and the charge generating layer 37.

In the OPC photosensitive member according to the present invention, photoconductive layer 33, the intermediate layer 35' used as desired, and the surface layer 34' efficiently accept the charge injection from the charging member 21, and effectively retain the electric charge. The inventors have found that surface layer 34' preferably comprises a high resistance resin material such as a mixture of high melting point polyester resin material and a cured resin material in which charge holding particles such as metal oxide, for example, Sn02 since then the above described conditions are satisfied as result of the respective characteristics as a synergism.

Examples of the resin materials for the surface layer 34', the photoconductive layer 33, the charge transfer layer 38 and the charge generating layer 37 will now be discarded.

The polyester is a bonded polymer of an acid component and alcohol, and is a polymer provided by condensation of dicarboxylic acid and glycol or condensation of hydroxy group of hydroxybenzoic acid and a chemical compound having carboxy group.

The acid component may be aromatic dicarboxylic acid such as terephthalic acid, isophthalic acid, naphthalenedicarboxylic acid, aliphatic croup dicarboxylic acid such as succinic acid, adipic acid, sebacic acid alicyclic dicarboxylic acid such as hexahydroterephthalic acid, hydroxy carboxylic acid such as hydroxyethoxy benzoic acid or the like.

The glycol component may be ethylene glycol, trimethylene glycol, tetramethylene glycol, hexamethylene glycol, cyclohexanedimetylol, polyethylene glycol, polypropylene glycol or the like.

Multifunctional compound such as pentaerythritol, polymethylolpropane, pyromellitic and ester formation derivative thereof may be copolymerized as long as the polyester resin material is substantially linear.

The polyester resin material may be a high melting point polyester resin material. The high melting point polyester resin material may be orthochlorophenol resin material having a limitating viscosity at 36° C. of not less than 0.4 dl/g, preferably not less than 0.5 dl/g, and further preferably not less than 0.65 dl/g. However, if the viscosity is too high, the operativity becomes worse, and the reaction is not sufficient, and the satisfactory property is not easily provided, and therefore, the limitating viscosity is preferably not more than 1.0 dl/g.

The preferable high melting point polyester resin materials in this embodiment includes polyalkyleneterephthalate resin materials. The polyalkyleneterephthalate resin material mainly comprises terephthalic acid as an acid component and alkyleneglycol as a glycol component.

More specific examples include polyethylene terephthalate (PET) mainly comprising terephthalic acid component and ethylene glycol component, polybutylene terephthalate (PBT) mainly comprising terephthalic acid component and 1,4-tetramethylene glycol (1,4-butylene glycol) component, (PCT) mainly comprising terephthalic acid component and cycloheXanedimetylol component, or the like.

Another example of the high molecular weight polyester resin material includes polyalkylenenaphthalate resin. The polyalkylenenaphthalate resin material mainly comprises naphthalenedicarboxylic acid as an acid component and alkyleneglycol as a glycol component, and a specific example thereof is polyethylenenaphthalate (PEN) mainly comprising a naphthalenedicarboxylic acid and an ethylene glycol component.

The high melting point polyester preferably has a melting point of not less than 160° C., further preferably not less than 200° C. Acrylic resin material is usable in place of the polyester resin material.

The usable binders include 2 functional acrylic resin, 6 functional acrylic resin, phosphazene or the like.

These resin material have a relatively high crystal property, and the engagement of the cured resin polymer chains and the high melting point polymer chains are dense and uniform, so that high durability surface layer can be provided.

In the case of the low melting point polyester resin material, the crystal property is low so that degree of the engagement is not uniform with the result that durability is low.

By the use of a material for the surface layer of the OPC photosensitive member, in which material a charge retaining material such as Sn0z is dispersed, the injection charging property is improved. The charge retaining material is preferably controlled in the resistance value and the charging efficiency by controlling the amount of the dispersion.

It is also effective to disperse fluorine resin material, thus reducing the surface energy of the surface of the OPC photosensitive member, thus improving the cleaning performance of the OPC photosensitive member. The fluorine resin material to be added may be polytetrafluoroethylene (PTFE) particles (Teflon®, trademark). The particle size of the Teflon® particle can be properly selected by one skilled in the art in consideration of the easy dispersion, electrical property such as charging power, the image quality, durability or the like. In this embodiment, the particle size is approx. 0.5 $\mu$m, and the results were good.

A description will now be made as to the case wherein an amorphous silicon photosensitive member (a-Si photosensitive member) is used.

According to the present invention, the a-Si photosensitive member may be a known one comprises a supporting member 31 and a photosensitive layer 32 including a photoconductive layer 33 of nonmonocrystal material having a silicon atom as a base material, but may have improved properties.

The a-Si having the improved polarities according to the present invention, comprises a photoconductive layer 33 comprising 10–30 atomic % of hydrogen, and the characteristic energy of exponential function (urbaccktail) of the subband gap light absorption spectrum thereof is 50–60 meV, and the localization state density is $1\times10^{14}$–$1\times10^{16}$cm–3.

Such an a-Si exhibits good temperature dependence of the charging power, and very good electrical optical, photoconductive properties, image quality, durability and use ambience properties.

The description will be made as to the photoconductive layer 32 of the a-Si for the image forming apparatus. FIGS. 3 (*a*)–(*e*) schematically show an example of a layer structure of the a-Si photosensitive member for an image forming apparatus according to the present invention.

As shown in FIG. 3 (*a*), in this embodiment, the a-Si photosensitive member 3 in the form of a drum comprises a supporting member 31 and a photosensitive layer 32 thereon. The photosensitive layer 32 comprises an amorphous hydride (a-Si:H) or (a-Si:X) comprising halogen atom) (a-Si:H, X) as a photoconductive layer 33 having a photoconductivity.

FIG. 3 (*b*) shows another example of layer structures, wherein the a-Si photosensitive member 3 comprises a photosensitive layer 32 provided an the supporting member 31 comprises a photoconductive layer 33 comprising a-Si:H, X, and an amorphous silicon surface layer 34.

FIG. 3. (*c*) shows another example of the layer structure, wherein the a-Si photosensitive member 3 includes a supporting member 31 and a photosensitive layer 32 comprising a photoconductive layer 33 comprising an a-Sl:H, X and an amorphous silicon charge injection blocking layer 35.

FIGS. 3 (*d*) and (*e*) show another example of the layer structure, wherein the a-Si photosensitive member 3 comprises a supporting member 31 and a photosensitive layer 32 thereon which comprises a photoconductive layer 33 including a charge generating layer 37 comprising a-Si:H, X and a charge transfer layer 38, and an amorphous silicon surface layer 34.

A description will now be made as to each layer constituting the a-Sl photosensitive member.

The supporting member 31 of the a-Si photosensitive member according to the present invention may be electroconductive or insulative.

The material of the electroconductive supporting member may be metal such as Al, Cr, Mo, Au, In, Nb, Te, V, Ti, Pt, Pd or Fe, or alloy thereof, for example, stainless steel.

The supporting member may be of film of synthetic resin material such as polyester, polyethylene, polycarbonate, cellulose acetate, polypropylene, polyvinyl chloride, polystyrene, polyamide like, or an electrically insulative supporting member such as a sheet, glass, ceramic or like, wherein a photosensitive layer side of the supporting member is treated for electroconductivity.

The surface of the supporting member 31 may be smooth or nonsmooth, and the supporting member 31 may be in the form of a cylinder, a plate or an endless belt or the like, and in this embodiment, it is in the form of a drum. The thickness thereof is determined so as to provide a proper photosensitive member for the image forming apparatus, but it is usually not less than 10 $\mu$m because of the manufacturing easiness and mechanical strength.

Particularly in the case that image recording is effected on the photosensitive member using coherent light such as a laser beam, the surface of the supporting member 31 maybe nonsmooth as long as decrease of the photogenerated carrier does not substantially occur, in order to effectively avoid the image defect resulting from interference fringe pattern which may appear in the visualized image (toner image). The nonsmoothness can be provided through a known method disclosed in, for example, Japanese Laid-open Patent Application No. SHO-60-168156, Japanese Laid-open Patent Application No. SHO-60-178457, Japanese Laid-open Patent Application No. SHO-60-225854, Japanese Laid-open Patent Application No. SHO-61-231561.

As another method for avoiding the image defect due to the interference fringe pattern more effectively, an interference preventing layer or region such as a light absorbing layer may be provided within or below the photosensitive layer 32. Alternatively, flawing the surface or the supporting member 31, the nonsmoothness can be provided on the photosensitive member surface. It can be accomplished by use of abradant, or etching using chemical reaction or dry etching, sputtering or the like in plasma. The size and the depth of the flaws will suffice if the decrease of the light generation carrier does not substantially occur.

A description will now be made as to the photoconductive layer 33 of the a-Si photosensitive member according to the present invention.

In order to accomplish the object of the present invention effectively, the forming film parameters of the photoconductive layer 33 constituting a part of the photosensitive layer 32 on the supporting member 31 or on a primer layer on the supporting member 31 as desired, are determined in the vacuum deposition film forming method so as to provided desired properties.

More specifically, it can be manufactured through a thin film accumulation method such as glow discharging method (low frequency CVD method, high frequency CVD method, microwave CVD method or another AC discharge CVD method or DC discharge CVD DC discharge CVD), sputtering method, vacuum deposition method, ion plating method, light CVD method, heat CVD or the like.

The selection may be made in consideration of the manufacturing condition, cost, manufacturing scale, properties required by the photosensitive member for the image forming apparatus, and in view of the fact that control of conditions in the manufacturing of the photosensitive member for the image forming apparatus is relatively easy, the glow discharging method, particularly the one using have a voltage source frequency in the range of the RF stripe, $\mu$W stripe or VHF stripe (high frequency glow discharging method).

In the formation of the photoconductive layer 33 through the glow discharging method, source material gas for supplying silicon atoms (Sl), source material gas for supplying hydrogen atoms (H) and/or source material gas for supplying halogen atoms (X), are introduced in desired gas states into a pressure-reduceable reaction container, and the glow discharge is produced in the reaction container so that layer comprising a-Si:H, X is formed on a supporting member 31 placed therein.

In order to compensate for the uncombined hand of the silicon atoms, thus improving the layer quality particularly improving the photoconductivity and the charge holding property, it is preferable that photoconductive layer 33 comprises hydrogen atom and/or halogen atoms, and it is desirable that the content of the hydrogen atoms and the halogen atoms or the sum of the hydrogen atoms and the halogen atoms is 10–30 atomic %, preferably 15–25 atomic % of the sum of silicon atoms, hydrogen atoms and/or halogen atoms.

In order to further facilitate the control of the introduction ratio of the hydrogen atoms into the photoconductive layer 33 to provide the film property, a desired amount of H2 and/or He or silicon chemical compound gas comprising hydrogen atoms may be mixed. The gases may be introduced in mixture.

Examples of the source material gas for supplying the halogen atoms usable with the present invention, are preferably halogen chemical compounds which are gasses or gassifiable, such as halogen gas, gassifiable halide, inter-halogen compound comprising halogen, silane derivative replaced with halogen. Other examples are slicon hydride compound comprising silicon atom and halogen atom which is in the state of gas or which can be gasified.

Examples of halogen chemical compound usable with the present intention are inter-halogen compounds such as fluorine gas ($F_2$), BrF, ClF, $ClF_3$, $BrF_3$, $BrF_5$, $IF_3$, $IF_7$. The silicon chemical compound comprising halogen atom, that is, the silane derivative replaced with halogen atom is preferably fluoride silicon such as $SiF_4$, $Si_2F_6$ or the like.

In order to control the amount of the hydrogen atoms and/or halogen atoms contained in the photoconductive layer 33, the temperature of the supporting member 31, the amount of introduction into the reaction container, of the source material which is used to supply the hydrogen atoms and/or the halogen atoms, the electric discharging power or the like, is controlled.

The photoconductive layer 33 in this embodiment preferably comprises atoms for controlling the conductivity as desired. The atoms for controlling the conductivity may be uniformly distributed in the photoconductive layer 33, or may be nonuniformly distributed in the direction of the layer thickness, partly.

The atoms for controlling the conductivity may be for example as so-called impurity in the semiconductor field, and may be p type atom of periodic table IIIbgroup (IIIb group atoms) or n type atoms of periodic table Vbgroup (Vb group atoms). Examples of IIIb group atoms are Phosphorus (P), boron (As), antimony (Sb), bismuth (Bi), and among them, P, As are preferable.

The content of the atoms contained in the photoconductive layer 33 for controlling the conductivity is preferably $1\times10^{-2}$–$1\times10x^{4}$ atomic ppm., further preferably $5\times10^{-2}$–$5\times10^{3}$ atomic ppm., and even further preferably $1\times10^{-1}$–$1\times10^{3}$ atomic ppm.

The atoms for controlling the conductivity, for example, IIIb group atoms or Vb group atoms are introduced in the layer formation process by introducing the source material for the IIIb group atom introduction or the source material for Vb group atoms introduction in the state of gas together with the other gases for formation of the photoconductive layer 33. The source materials for the IIIb group atoms introduction and the Vb group atoms introduction are the ones which are in the gas state under the normal temperature and pressure or which are easily gassified under the layer forming conditions.

The examples of the source material for the IIIb group atoms introduction are boron hydride such as $B_2H_6$, $B_4H_{10}$, $B_5H_9$, $B_5H_{11}$, $B_6H_{10}$, $B_6H_{12}$, $B_6H_{14}$, boron halide such as $BF_3$, $BC_{13}$, $BBr_3$. Other examples are $AlCl_3$, $GaCl_3$, $Ga(CH_3)_3$, $InCl_3$, $TlCl_3$.

The preferable source material for the Vb group atoms introduction are phosphorus hydride such as $PH_3$, $P_2H_4$, or phosphorus halide such as $PH_4I$, $PF_3$, $PF_5$, $PCl_3$, $PCl_5$, $PBr_3$, $PBr_5$ $Pl_3$, for phosphorus atoms introduction. As other examples, $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BICl_3$, $BiBr_3$, are usable as a starting material for the Vb group atoms introduction.

The source material for the atoms introduction for the control the conductivity may be diluted by H2 and/or He.

In this environment, the photoconductive layer 33 may comprise carbon atoms and/or oxygen atoms and/or nitrogen atoms. The content of the carbon atom and/or oxygen atom and/or nitrogen atom is preferably $1\times10^5$–10 atomic %, further preferably $1\times10^{-4}$–8 atomic %, even further preferably $1\times10^{-3}$–5 atomic % of the sum of the silicon atoms, carbon atoms, oxygen atoms and nitrogen atoms. The carbon atoms and/or oxygen atoms and/or nitrogen atoms may be uniformly distributed in the photoconductive layer or may be nonuniformly distributed in the direction of the layer thickness of the photoconductive layer, partly.

The layer thickness of the photoconductive layer 33 according to this embodiment is determined from the standpoint of the electrophotographic property and the cost, but it is preferably 20–50 $\mu$m, further preferably 23–45 $\mu$m and even further preferably 25–40 $\mu$m.

The temperature of the supporting member 31 for forming the photoconductive layer thereon is properly determined in accordance with the layer design, but normally, it is preferably 200–350° C., further preferably 230–330° C., and even further preferably 250–310° C.

The supporting member temperature, the gas pressure or like in the formation of the photoconductive layer 33, are not independently determined, but are properly determined in consideration of the mutual and organic interrelationship.

A description will now be made as to the surface layer 34 of the a-Si photosensitive member.

The surface layer 34 of the amorphous silicon is formed on the photoconductive layer 33 which has been formed on the supporting member 31 in the manner described above. The surface layer 34 has a free surface to provide mainly moisture resistance, continuous use property, electrical withstand pressure temperature property, ambience property, and durability.

The material of the surface layer 34 is any amorphous silicon material such as an amorphous silicon (a-si C:H, X) comprising a hydrogen, atom (H) and/or a halogen atom (X) and a carbon atom, an amorphous silicon (a-si N:H, X) comprising a hydrogen atom (H) and/or a halogen atom (X) and a oxygen atom, an amorphous silicon (a-si N:H, X) comprising a hydrogen atom (H) and/or a halogen atom (X) and a nitrogen atom, amorphous silicon (a-Si CON H, X H, X) comprising a hydrogen atom (H) and/or a halogen atom (X) and at least one of a carbon atom, oxygen atom, nitrogen atom.

The surface layer 34 can be formed through known thin film accumulation method such as a glow discharging method CVD (a AC discharge CVD method such as low frequency CVD, high frequency CVD method or microwave CVD method or DC discharge CVD DC discharge CVD method), a sputtering method, a vacuum deposition method, an ion plating method, a light CVD, a heat CVD or the like. The selection may be made in consideration of the manufacturing condition, cost, manufacturing scale, properties required by the photosensitive member for the image forming apparatus, and in view of the fact that control of conditions in the manufacturing of the photosensitive member for the image forming apparatus. From the standpoint of the productivity of the photosensitive member, the accumulation method similar to the case of the photoconductive layer 33 is preferred.

When the surface layer 34 comprising a-Si C:H, X is formed through the glow discharging method, the source material gas for supplying the silicon atoms (Si), the source material gas for supplying the carbon atoms (C), the source material gas for supplying the hydrogen atom (H) and/or the source material gas for supplying the halogen atoms (X), are introduced in desired gas state into a pressure-reduceable reaction container, and the glow discharge is produced in the reaction container, by which a layer comprising a-Si C:H, X is formed in on the supporting member 31 on which the photoconductive layer 33 has been formed.

The amount of carbon when the surface layer 34 comprises the a-Si C as a major component, is preferably in the range of 30%–90% of a sum of the silicon atoms and the carbon atoms.

By controlling the hydrogen content in the surface layer to be not less than 30 atomic % and not more than 70%, a remarkable improvement is provided in the electrical property and the high speed continuous use property with high hardness of the surface layer maintained.

Here, the hydrogen content in the surface layer can be controlled by the flow rate of the H2 gas, the temperature of the supporting member, the discharging power, the gas pressure or the like. In order to control the amount of the hydrogen atoms and/or the amount of the halogen atoms, the temperature of the supporting member 31, the amount of the source material supplied for the hydrogen atoms and/or the halogen atoms into the reaction container, the electric discharging power or the like, is controlled. The carbon atoms and/or the oxygen atoms and/or the nitrogen atoms may be distributed uniformly in the surface layer or may be nonuniformly distributed therein in the direction of the layer thickness of the surface layer, partly.

morever, the surface layer 34 of the a-Si photosensitive member according to this embodiment may comprise atoms for controlling the conductivity. The atoms controlling the conductivity may be distributed uniformly in the surface layer 34 or may be distributed nonuniformly in the direction of the layer thickness, partly.

Here, the atoms for controlling the conductivity may be a so-called impurity in the semiconductor field, and it may be IIIb group atoms or Vb group atoms. The source material for the atoms introduction for controlling the conductivity may be diluted by H2, He, Ar, Ne gases.

The layer thickness of the surface layer 34 according to this embodiment is normally 0.01–3 $\mu$m, preferably 0.05–2 $\mu$m, even further preferably 0.1–1 $\mu$m. If the layer thickness is less than 0.01 $\mu$m, the surface layer 34 is scraped out due to wearing during use of the photosensitive member, and if it exceeds 3 $\mu$m, the deterioration of the electrophotographic property such as rising of the residual potential.

In order to provide the surface layer 34 having the properties of the present invention, the temperature of the supporting member 31, the gas pressure in the reaction container is properly selected. The conditions of the temperature, the gas pressure of the supporting member 31 in the formation of the 34 are not independently determined, but are determined in consideration of the mutual and organic interrelationship among them so as to provide the desired properties.

In the a-Si photosensitive member according to the present invention, a blocking layer (lower surface later) comprising small amount of carbon atoms, oxygen atoms, nitrogen atoms than in the surface layer may be provided to improve the charging power or other properties.

Between the surface layer 34 and the photoconductive layer 33, there may be provided a region in which the content of the carbon atoms and/or the oxygen atoms and/or the nitrogen atoms decreases toward the photoconductive layer 33. By doing so, the adhesiveness between the surface layer 34 and the photoconductive layer 33 can be improved so that influence of the interference to the light reflection after the interface, can be suppressed.

In addition, use can be made with an amorphous carbon film a-C:H comprising a carbon as a major component, for the surface layer. Such a-C:H has a high hardness and high durability. In addition, the friction is low, and therefore, the water repellence is good, and even it the heater is omitted, blurriness can be prevented under the high humidity ambience. Additionally, the movement of the charging-promotion particles or other particles toward the photosensitive member due to the mechanical friction can be suppressed.

The surface layer 34 may be an amorphous carbon film (a-C:H:F) comprising carbon as a major component and bond with fluorine inside and/or the outermost part. The a-C:H:F exhibits high water repellelency, low friction, and even if the heater is omitted, the blurriness can be avoided.

The description will be made as to the charge injection blocking layer of the a-Si photosensitive member of this embodiment.

It is preferable to provide a charge 1njection blocking layer 35 having a function of preventing injection of the electric charge from the electroconductive supporting member, between the electroconductive supporting member and the photoconductive layer 33. When the free surface of the photosensitive layer 32 is subjected to the charging of the predetermined polarity, the charge injection blocking layer 35 functions to prevent the electric charge from injecting into the photoconductive layer 33 from the supporting member 31, but when it is subjected to the charging of the opposite polarity, it does not prevent the injection, that is, it provides a polarity dependence.

In order to provide such a function, the charge injection blocking layer 35 comprises a relatively larger amount of atoms for controlling the conductivity than in the photoconductive layer 33. The atoms for controlling the conductivity, contained in the charge injection blocking layer 35, may be distributed uniformly in the charge injection blocking layer 35, or may be distributed nonuniformly in the direction of the layer thickness, partly. When the distributed density is nonuniform, it is preferable that density is higher adjacent supporting member 31. It is preferable that irrespective of whether the distribution of the atoms controlling the conductivity is uniform or not in the direction of the layer thickness in the charge injection blocking layer, the distribution is uniform ln the plane parallel with the surface of the supporting member 31 in order to provide uniform property over the charge injection blocking layer 35.

The atoms for controlling the conductivity in the charge injection blocking layer 35 may be a so-called impurity in the semiconductor field and may be III group atoms or V group atoms. In this embodiment, the layer thickness of the charge injection blocking layer 35 is preferably 0.1–5 $\mu$m, further preferably 0.3–4 $\mu$m and even further preferably 0.5–3 $\mu$m from the economical standpoint and from the standpoint of the electrophotographic properties.

The desirable ranges of the mixing ratio of the dilution gas, the gas pressure, the electric discharging power under the supporting member temperature in the formation of the charge injection blocking layer 35 in this embodiment, are the same as those with the photoconductive layer 33, but these factors are not independent, but have a mutual and organic relationship, which should be considered when the factors are determined.

In order to further enhance the contactness between the supporting member 31 and the photoconductive layer 33 or the charge injection blocking layer 35 in the a-Si photosensitive member for the image forming apparatus in this embodiment, there may be provided a close contact layer comprising si3N4, $SiO_2$ or SiO or an amorphous material comprising silicon atoms as a base material, hydrogen atoms and/or halogen atoms, carbon atoms and/or oxygen atoms and/or nitrogen atoms. Moreover, a light absorbing layer may be provided to prevent occurrence of interference figure due to the reflected light from the supporting member 31 as described hereinbefore.

The description will be made as to an apparatus for manufacturing the a-Si photosensitive member described in the foregoing.

Figure 4:
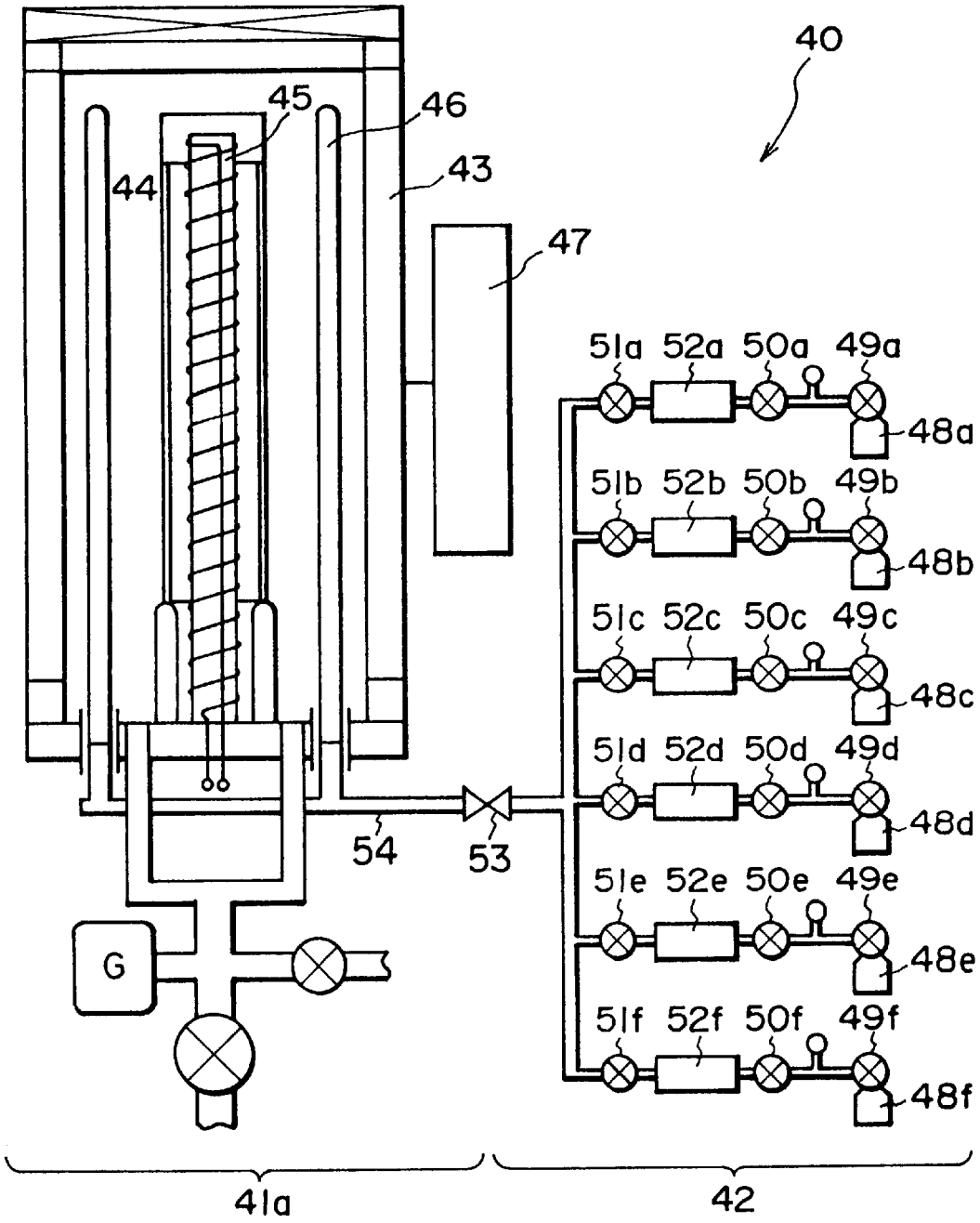
FIG. 4 is a schematic view of an example of a manufacturing apparatus of an electrophotographic photosensitive member using amorphous silicon manufactured through glow discharge using RF band high frequency.
Figure 5:
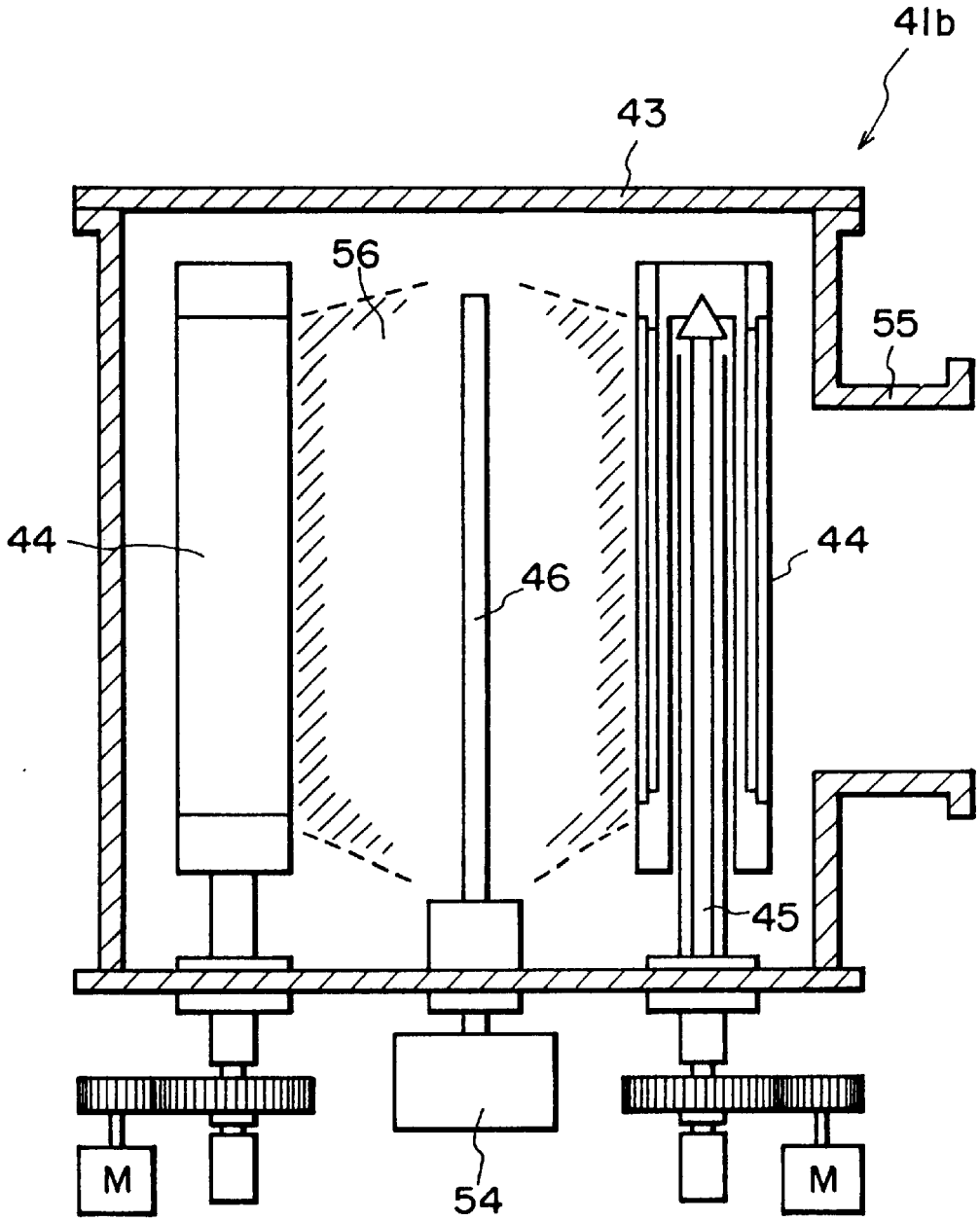
FIG. 5 is a schematic view of an example of a manufacturing apparatus for an electrophotographic photosensitive member of amorphous silicon manufactured through glow discharge using VHF band high frequency.

Each layer of the a-Si photosensitive member is formed through a film forming method using the known film forming apparatus shown in FIGS. 4, 5.

FIG. 4 is a schematic view of a manufacturing apparatus of an a-Si photosensitive member for an image forming apparatus using a high frequency plasma CVD (RF-PCVD) with a RF stripe as a voltage source frequency.

The manufacturing apparatus 40 comprises an accumulation apparatus 41*a*, a source material gas supplying device 42, and an exhausting device for reducing the pressure in a reaction container 43.

The reaction container 43 in the accumulation apparatus 41*a* is provided with a cylindrical supporting member 44, heater 45 for heating the supporting member, a gas source introduction pipe 46, and a high frequency matching box.

The gas source supplying device 42 includes cylinders 48*a*–48*f* for the source material gas such as $SiH_4$, $GeH_4$, $H_2$, $CH_4$, $B_2H_6$, $PH_3$ or the like, valves 49*a*–49*f*, 50*a*–50*f*, 51*a*–51*f*, and mass-flow controllers 52*a*–52*f*, wherein the cylinders for the source material gas are connected with the gas introducing tube 46 in the reaction container 43 through valve 53 and manifold 54.

FIG. 5 shows an example of an accumulation apparatus used in the manufacturing apparatus for the a-Si photosensitive member for the image forming apparatus using the high frequency plasma CVD method (VHF-PCVD) with a frequency in the VHF stripe as a voltage source.

As shown in FIG. 5, the accumulation apparatus 41*b* can replace the accumulation apparatus 41*a* of the manufacturing apparatus shown in FIG. 4 which is for the manufacturing of the a-Si photosensitive member using the RF-PCVD method. That is, it is usable by connecting with the gas source supplying device 42 shown in FIG. 4.

The accumulation apparatus 41*b* has a vacuum sealed structure and comprises a pressure-reduceable reaction container 43 and an exhausting device for reducing the pressure in the reaction container 43, and is connected with the gas source supplying device 42 shown in FIG. 4.

In the reaction container 43, there are provided a cylindrical supporting member 44, a supporting member heating heater 45, a gas source introduction pipe 46 and electrodes to which the high frequency matching box is connected.

The inside of the reaction container 43 is connected with a diffusion pump through an exhausting pipe 55.

The gas source gas supplying device 42 has the same structure as the above described one, and the cylinder of the source material gas is connected with the gas introducing tube 46 in the reaction container 43 through a valve. A space 56 enclosed by the cylindrical supporting member constitutes a discharging space.

In the foregoing, the description has been made as to the structures of the image forming apparatus according to an embodiment of the present invention, the CLN charging member 21 according to one embodiment, the charging-promotion particles according to an embodiment, and the photosensitive member for the image forming apparatus according to an embodiment.

According to these environments, the CLN charging member, the charging-promotion particles and the photosensitive member provide advantageous effects, respectively, but combinations thereof provide better and advantageous effects.

The description will be made as to the entire operation of the image forming apparatus.

The image forming apparatus shown in FIG. 1 which is in the form of a copying machine, comprises a photosensitive member 3 hope (a electrophotographic photosensitive member in the form of a drum) as an image bearing member, and the photosensitive member 3 rotates in the direction of arrow X at a predetermined peripheral speed (process speed). In this embodiment, the photosensitive member 3 is the member to be charged.

The photosensitive member 3 and the CLN charging member 21 form a contact nip, which is set and controlled stably by spacer (unshown) to maintain the contact area contributable to assure the property and the charging properties. There may be provided a mechanism for adjustment of the nip, for example, a mechanism for urging the CLN charging member 21 to the photosensitive member 3 by a spring having a spring constant corresponding to the hardness of the CLN charging member 21.

Figure 6:
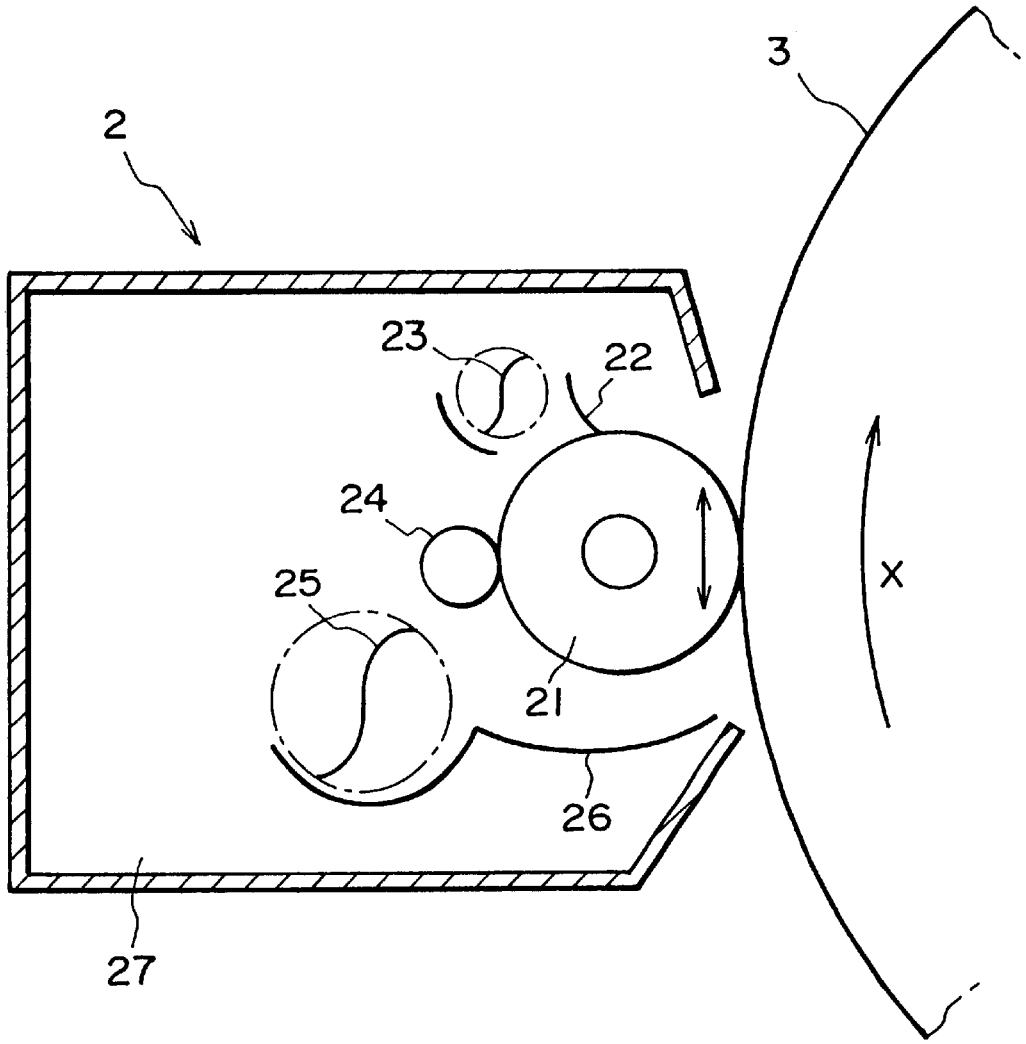
FIG. 6 is an illustration of a structure around a contact portion between the CLN charging member and the photosensitive member according to an embodiment of the present invention.

FIG. 6 shows more in detail an example of a charging and cleaning device 2 using the CLN charging member 21.

The CLN charging member 21 is disposed so as to form a predetermined nip with the surface of the photosensitive member 3. The charging member 21 is driven out a predetermined relative speed relative to the photosensitive member 3 rotating at a predetermined process speed in the direction of arrow X.

In the rear side of the CLN charging member 218, as seen from the photosensitive member 3, a doctor roller 24 is contacted to the charging member 21, the doctor roller 24 functions to make uniform in the longitudinal direction of the charging member 21 the untransferred toner or the like collected on the surface of the CLN charging member 21 from the photosensitive member 3, and the excessive toner or the like is removed and transported into a residual toner container 26 from the CLN charging member 21. Then, the toner or the like is transported to a residual toner container by a residual toner transportation system 25. Or, when a toner reusing mechanism (unshown) is provided, the toner or the like is transported to the toner reusing mechanism by the residual toner transportation system 25. In place of the doctor roller 24, a doctor blade is usable.

The charging-promotion particles may be the toner particles, or other particles are usable.

In this embodiment, the mechanism for removing the particles such as toner particles from the CLN charging member 21, but, as desired, the CLN charging member 21 may be provided with a mechanism (unshown) for supplying fine particles for the charging performance enhancing.

Figure 7:
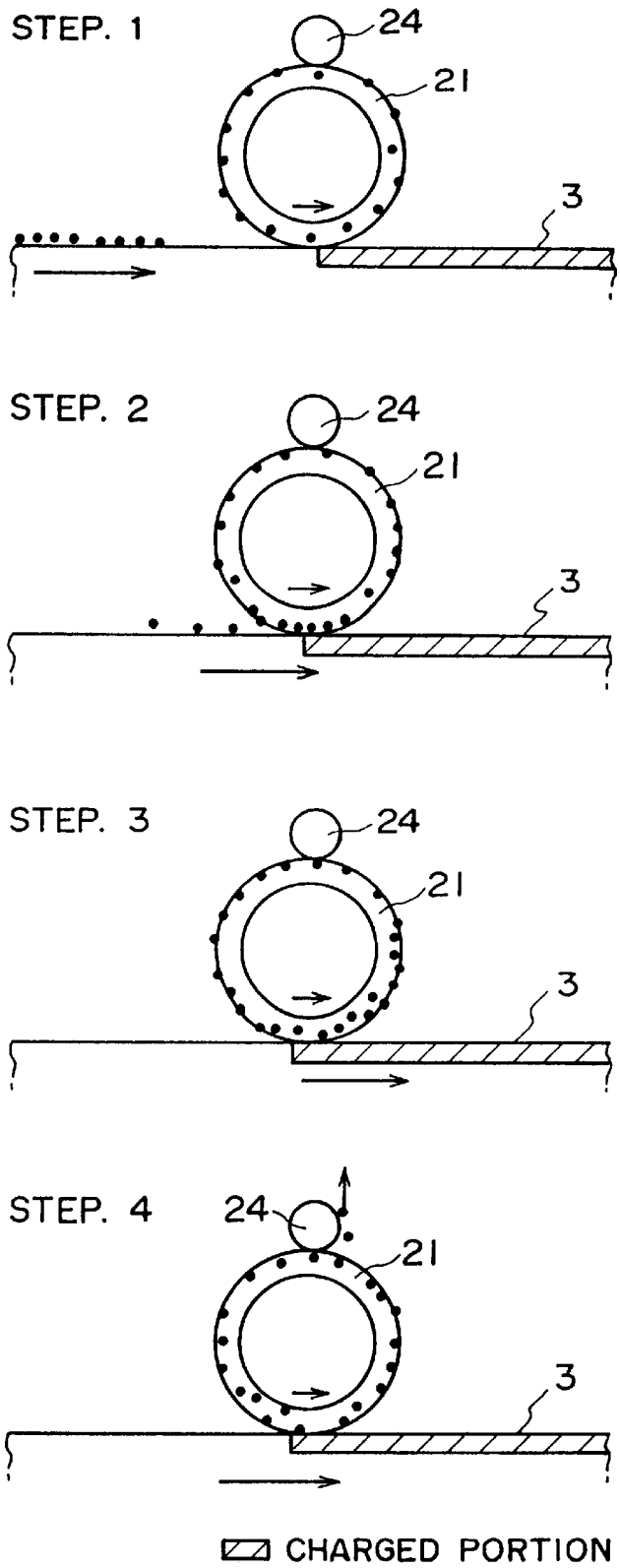
FIG. 7 is the schematic view of cleaning and charging action of the CLN charging member to the photosensitive member according to an embodiment of the present invention.

A description will now be made as to the operation of the charging and cleaning. FIG. 7 shows the charging and cleaning operation adjacent the contact nip between the CLN charging member 21 and the photosensitive member 3.

(Step-1) the photosensitive member 3 is rotated at the predetermined peripheral speed so that surface of the photosensitive member 3 moves in the direction of the arrow. The CLN charging member 21 is rotated by driving means (unshown) such that surface opposed to the photosensitive member 3 at the contact nip moves in the same direction as the photosensitive member 3 with a relative peripheral speed.

In the developing process, the electrostatic latent image is developed into a toner image, and the toner image is transferred onto a transfer material by transfer means. Thereafter, the untransferred toner or the like remaining after the image transfer onto the transfer material, is attracted on the surface of the photosensitive member 3 by the electrostatic force (Coulomb force), intermolecular force, frictional force or another force, and approaches to the CLN charging member 21 in the charging and cleaning device.

At this time, the CLN charging member 21 is charging the surface of the photosensitive member 3 to a predetermined potential. The charging will be described in Step -3 hereinafter.

(Step-2) in the nip with the photosensitive member 3, the CLN charging member 21 rubs the surface of the photosensitive member 3, by which the untransferred toner or the like is stopped by the pits or pores on the surface of the sponge layer 21*b* of the charging member or is scraped thereby, and is collected into the charging and cleaning device.

(Step-3) the CLN charging member 21 is supplied with a voltage by voltage applying means (unshown) so that electric charge is directly injected into the surface of the photosensitive member 3 in the nip between the photosensitive member 3 and the CLN charging member 21 to electrically charged the surface of the photosensitive member 3 to a predetermined potential.

For the purpose of lubricity, contact property and chargeable relative to the photosensitive member 3, the CLN charging member 21 may comprising fine powders applied thereon. As shown in FIG. 7, the sponge layer 21*b* of the CLN charging member 21 is coated with are part of the untransferred toner (FIG. 2) and/or with charging-promotion particles supplied by a proper method, so that coating particle layer 21*c* is formed (FIG. 2) thereon.

The charging-promotion particles including the toner used for development may be magnetic or non-magnetic. During the charging operation, an electric field is formed, and a current flows between the surface of the photosensitive member 3 and the CLN charging member 21.

Here, the forces applied to the particles on the surface of the CLN charging member 21 will he considered. As the forces retaining the particles on the surface of the CLN charging member 21, there are frictional force between the particles and the surface of the CLN charging member 21 and in the mechanical retaining force provided by the surface shape of the CLN charging member. On the other hand, as the forces urging the particles toward the surface of the photosensitive member 3, there is a force provided by the electric field and the Coulomb force due to the potential difference between the CLN charging member 21 and the photosensitive member 3, and frictional force.

However, in the case of the CLN charging member 21 according to this embodiment, the particles are captured and retained in the pits formed on the surface of the sponge layer 21*b* (FIG. 2l), and therefore, as compared with the case of the conventional magnetic brush, the charging, the leakage of the particles can be properly controlled at low cost.

(Step-4) the untransferred toner or the like captured by the CLN charging member 21 is partly made uniform in the longitudinal direction on the surface of the CLN charging member 21 by the doctor roller 24, and a part of the particles is collected in the charging and cleaning device, and the other remains on the sponge layer 21*b* (FIG. 2) of the CLN charging member 21.

The collected untransferred toner or the like is received by the residual toner container 27 (FIG. 6), or is further transported to the toner reusing mechanism (unshown).

The residual toner container 27 may be disposed at an unshown partition in the image forming apparatus. For example, when it is detachably mounted to the main assembly of the image forming apparatus in the form of a cartridge (including the charging and cleaning device), it may be incorporated in the cleaning device.

In the foregoing, the description has been made as to the charging and cleaning process in the contact nip between the CLN charging member and the photosensitive member 3. In this embodiment, the surface of the photosensitive member 3 and the CLN charging member 21 are moved in the contact nip in the same directions, but the present invention is not limited to this example, and they may be moved in the opposite directions to each other. As desired, in order to prevent falling of the particles such as toner particles, a receptor sheet may be provided.

FIG. 8 shows capture and retaining of the particles such as toner particles by the CLN charging member 21 when the surface of the photosensitive member 3 and the surface of the CLN charging member 21 move codirectionally and when they are moved counterdirectionally. In FIG. 8(*a*), the surface of the photosensitive member 3 and the surface of the CLN charging member move codirectionally in the contact portion. In FIG. 8(*b*), they are moved counterdirectionally.

As will be understood from FIGS. 8(*a*), (*b*), in the codirectional case, the particles first enter the pore portion in the surface of the CLN charging member 21, and thereafter, the particles further enter the pore portion and are deposited on the surface of the CLN charging member as if they are sandwiched between the members with the rotation of the members. In the counterdirectional case, the particles first enter the pore portion in the surface of the CLN charging member 21, and thereafter, with the location of the members, the CLN charging member 21 takes up the particles into the pore portion and the other surface portions of the CLN charging member.

According to the image forming apparatus of this embodiment, the CLN charging member 21 can stably retain the charging-promotion particles on its surface, and therefore, the state of contact between the CLN charging member 21 and the photosensitive member 3 contact state can be maintained properly, and because of the motion of the charging performance enhancing particles in the contact nip between the CLN charging member 21 and the photosensitive member 3, the uniform contact charging is accomplished for the photosensitive member.

By the use of the photosensitive member having the improved temperature property and electrical property, high-quality images can be formed for a long term.

Additionally, the image defect attributable to the projections of the photosensitive member 3 can be suppressed. By the existence of the charging-promotion particles, the increase of the effective contact area in the contact nip and uniform contact are accomplished so that fine abnormal discharge can be prevented, and therefore, the damage attributable thereto can be avoided, and the growth of the image defects can be avoided.

The experiments have been carried out to form images while changing the diameter of the toner particles, and it has been confirmed that toner deposited on the photosensitive member is not easily removed therefrom, so that black stripes (fusing) can be suppressed. This is because the CLN charging member 21 is contacted to the photosensitive member 3 uniformly with a high density so that cleaning effect is improved.

Furthermore, the durability tests were carried out, and the improvement in the contamination level of the CLN charging member 21 was confirmed. This is because even in the paper dust in the image forming apparatus are incorporated in the charging and cleaning member 21, the contamination particles such as the paper dust are quickly discharged by the flow of the particles including the untransferred toner particles and the charging-promotion particles. This further expands the service life.

(Embodiment 2)

As described in the foregoing, a conventional electrophotographic photosensitive member is usable, but the electrophotographic photosensitive member according to the present invention is particularly advantageous. The description will be made as to the evaluations of the various properties of the photographic photosensitive member and as to the electrophotographic photosensitive member suitable with the use of the present invention.

In this embodiment, use is made of a manufacturing apparatus for the a-Si photosensitive member for an image forming apparatus using a RF-PCVD, and the charge injection blocking layer 35, the photoconductive layer 33 and the surface layer 34 are formed on the machine and washed aluminum cylinder under the conditions shown in table 1, thus forming an a-Si photosensitive member in the form of a drum. In addition, various a-Si photosensitive members are manufactured with the different mixture ratio of the SiH4 and the H2 in the photoconductive layer and with different electric discharging powers.

TABLE 1

| | injection blocking layer | photocon. layer | surface layer |
|---|---|---|---|
| gas amount and rate | | | |
| $SiH_4$ [SCCM] | 100 | 200 | 10 |
| $H_2$ [SCCM] | 300 | 800 | |
| $B_2H_6$ [PPM] (to $SiH_4$) | 2000 | 2 | |
| NO [SCCM] | 50 | | |
| $CH_4$ [SCCM] | | | 500 |
| support temp [° C.] | 290 | 290 | 290 |
| pressure [Pa] | 50 | 65 | 65 |
| Power [W] | 500 | 800 | 300 |
| Thick [μm] | 3 | 30 | 0.5 |

The a-Si photosensitive member manufactured under the conditions shown in Table 1, is set in an image forming apparatus (NP6750 available from Canon Kabushiki Kaisha, Japan), and the temperature dependence (temperature property) of the charging power of the a-Si photosensitive members and the memory and the image defects. In the image forming apparatus used in the test, a charging roller and a belt-like charging device was used for the transfer and separation charging devices respectively.

The temperature property are evaluated in the following manner.

As regards, the temperature property, the surface potential (dark potential Vd) of the photosensitive member 3 is measured without projecting light to the surface of the photosensitive member 3 while the surface temperature oi the photosensitive member temperature particularly is being changed from the room temperature to 45° C. and the temperature property is determined as the change ratio of the dark potential Vd per 1° C. The change of the charging power per 1° C. is measured, and the change ratio within 2 V/°C. is discriminated as satisfactory.

As regards the image evaluation with respect to the light memory, image flow, roughness or like, continuous image formations are carried out under the proper ambient conditions of the following temperature (°C.) and humidity (RH) conditions or under all conditions, and then, the evaluation is carried out.

35+2° C., 85 and 2° C., 85±10% RG (H/H ambience):

25+2° C., 10±5% RH (N/L ambiance):

15+2° C., 10±5% RH (L/L ambiance):

In the evaluation, when the image quantities are different depending on the ambient conditions, the variation awards based on the worst image quality.

The evaluation with respect to the fog were made in the following manner.

The fog is the foggy background or foggy solid white portion (non-image region) produced by improper cleaning, that is, such a portion has a density. The fog was evaluated using three color (black/half-tone/white) chart (Canon test chart FY9-9017-000), and NA-7 chart (Canon test chart FY9-9060-000).

The image forming operations were carried out in each of the ambient conditions, and the sharpness at the edges of the images, the stripe produced by toner leakage and extending along the rotational direction of the photosensitive member and the fog were evaluated.

The fog was detected using a reflection density meter (reflection meter model TC-6DS, available from TOKYO DENSHOKU KABUSHIKI KAISHA, and the amount of the fog was determined as Ds-Dr, where Ds is the worst level of the reflection density in the white background portion after the image formation, and Dr is the reflection average density of the transfer material P before the image formation. The following 5-level standard was used:

1. Excellent: Ds-Dr<1.0%

Leakage line: No:

2. Good: 1.0≦Ds−Dr<1.3%

Leakage line: No:

3. Substantially good. 1.3≦Ds−Dr<1.7%

Leakage stripe: not more than 0.5 mm and not more than 3:

4. Substantially no problem: 1.7≦Ds−Dr<2.0%:

Leakage stripe: not more than 1 mm and not more than 3:

5. Practically slightly problematic: 2.0%≦Ds−Dr:

Leakage stripe: more than 1–4

As regards the evaluation with respect to the fog, the levels 1–3 were evaluated as being satisfactory.

The light memory was evaluated in the following manner:

For the evaluation with respect to the light memory, the use was made with a half-tone chart, (Canon test chart FY9-9042-000 or FY9-9098-000) and ghost image chart (Canon test chart FY9-9040-000).

As regards the light memory, the images formed under the respective ambient conditions were observed through a microscope, and the image densities were measured, as follows.

The density detection was carried out using a reflection density meter available from Macbeth. The amount of the light memory was determined as Dm−Dr, where Dr is an average reflection density of the halftone after the image formation, and Dm is the reflection average density of the light memory portion in the halftone image part, and the evaluation was made with the following 5-level criterion for evaluation.

1. Excellent: the light memory is less than 0.05:

The light memory is invisible.

2. Good: the light memory is not less than 0.05 and less than 0.10:

The density difference is hardly visible.

3. Quite good: the light memory is not less than 0.10 and less than 0.15:

The light memory can be slightly visible.

4. Practically no problem: the light memory is not less than 0.15 and less than 0.20:

The light memory is visible.

5. Slightly problematic: the light memory is not less than 0.35:

The light memory is visible.

The image flow was evaluated in the following manner:

The image forming apparatus incorporating the sample a-Si photosensitive member and the toner was left under the H/H ambience for at least 72 hours, so that stable state was established in the machine. Thereafter, 50,000 image forming operations were carried out on sheet, and then the main switch is shut off, and the machine is left for 24 hours.

After it was left for 24 hours, 100 continuous image forming operations were carried out, and the output images were checked.

The optional image charts used were Canon test chart FY9-9058-000 and NA-7 (Canon test chart FY9-9060-000).

As regards the evaluations of the image flow, the image observation was carried out using a microscope, and the evaluation was made on the basis of the blurness of the clearances between thin lines.

1. Excellent: the blurred range is not less than 9.0:

Visible.

2. Good: the blurred range is not less than 7.1:

Generally visible.

3. Fair: the blurred range is not less than 5.0:

Visible.

4. Practically no program: the blurred range is not less than 4.5:

Visible.

5. Practically problematic: the blurred range is not more than 4.0 or less than 4.5:

Clearly visible.

The roughness of the image was evaluated in the following manner:

The image forming apparatus incorporating the sample a-Si photosensitive member and toner was left under each of the ambient conditions for at least 27 hours so that stable ambiance is established in the image forming apparatus. Thereafter, 50,000 sheets were processed, and the voltage source of the image forming apparatus was shut off.

After the machine was left off for 24 hours, 100 continuous image forming operations were carried out, and the roughness of these images were evaluated.

As for the original of the image formations, NA-7 chart (Canon test chart FY9-9060-000), and halftone chart (Canon test chart FY9-9042-000 or FY9-9098-000) were used.

As regards the evaluation with respect to the roughness, the images were observed using a microscope, and the evaluation was made on the basis of the range in which thin lines were broken due to the roughness, and the evaluation was made using five levels.

1. Excellent: the range is not less than 9.0:

Invisible.

2. Good: the range is not less than 7.1:

Hardly visible.

3. Fair: the range is not less than 5.0:

Hardly visible.

Practically no problem: the range is not less than 4.5:

Visible.

5. Practically problematic: the range is not more than 4.0 (less than 4.5):

Clearly visible.

In each of the evaluation, the drum heater or the like has been omitted, in evaluation. For the durability test, the used original was Tc-A1 (Canon test chart FY9-9045-000. The image samples are outputted several times for each test chart.

On the other hand, a sample photosensitive member was produced by accumulating an a-Si film having a film thickness approx. 1 $\mu$m on a glass substrate (Corning 7059) and a Si wafer placed on a cylindrical sample holder, under the conditions for producing the photoconductive layer. On the accumulated film on the glass substrate, a comb-like electrode of A1 was deposited by evaporation, and the characteristic energy (Eu) of the exponential function tail and the localization state density (D. O. S.) was measured. The contained hydrogen and the hydrogen bond ratio (Si-H2/Si-H) of the accumulated film on the Si wafer was measured by FTIR.

Figure 10:
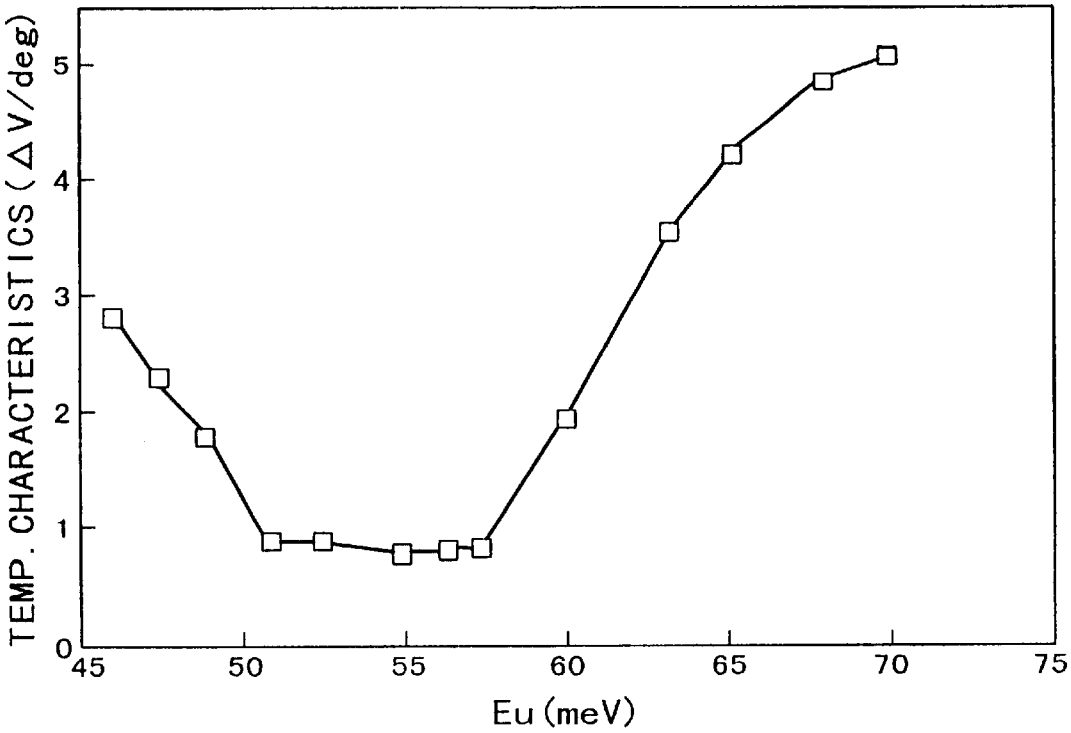
FIG. 10 is a graph showing a relationship between a temperature property and characteristic energy (Eu) of exponential function tail (arbacktail) Of the photosensitive layer of the amorphous silicon photosensitive member according to an employment of the present invention.
Figure 11:
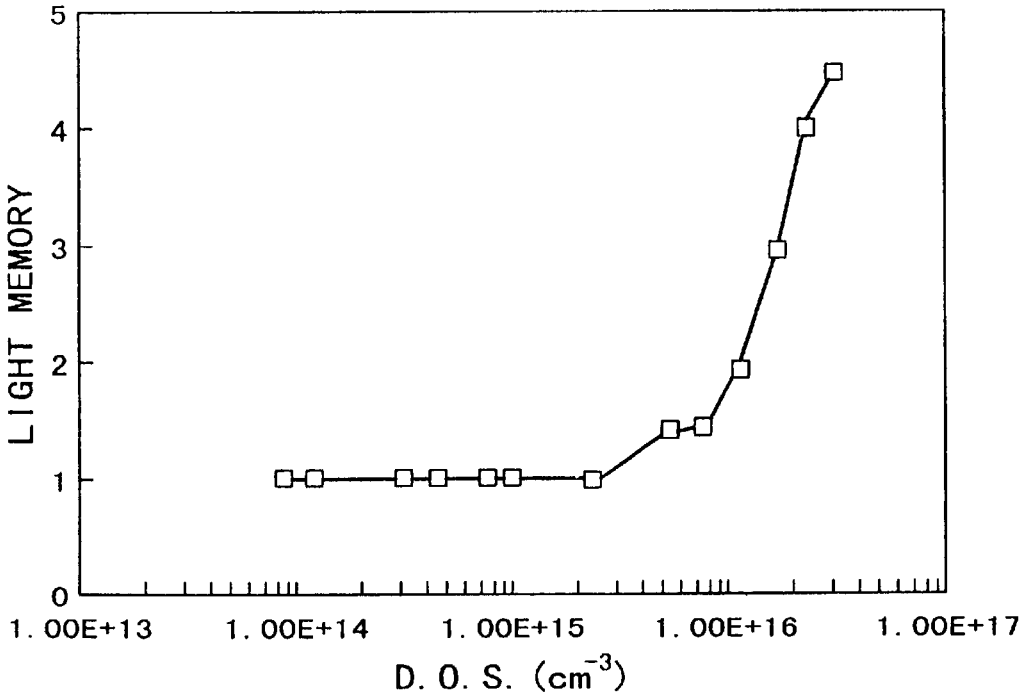
FIG. 11 is a graph showing the relationship between localization state density (D.O.S.) of the photoconductive layer of the amorphous silicon photosensitive member and the light memory according to one member event of the present invention.
Figure 12:
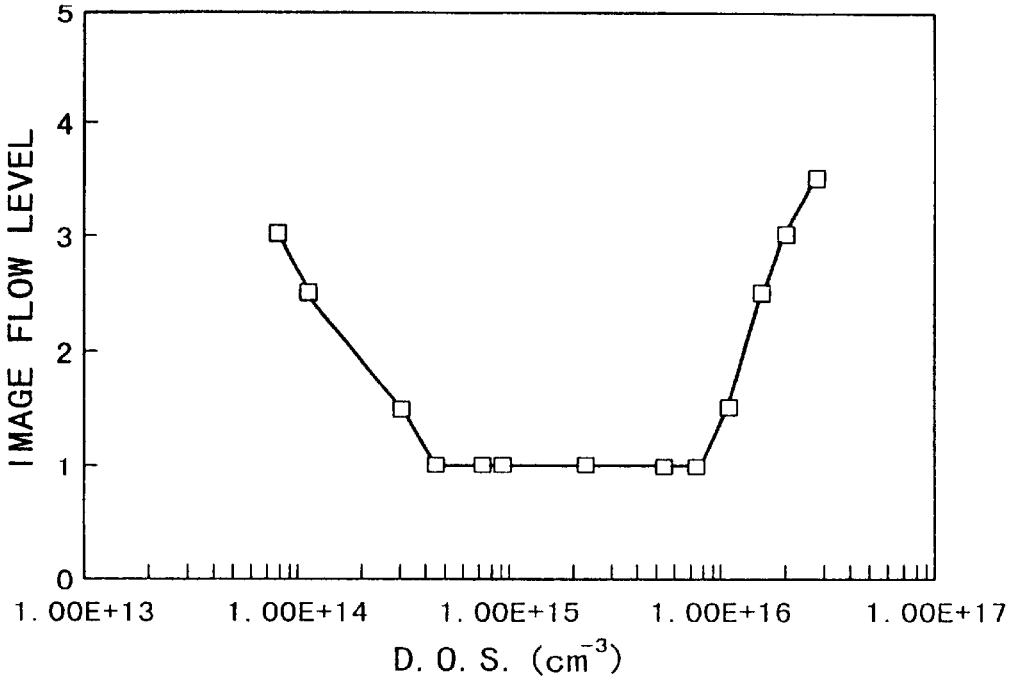
FIG. 12 is a graph showing the relationship between the localization state density (D.O.S.) of the photoconductive layer of the amorphous silicon photosensitive member according to an embodiment of the present invention.

FIGS. 10, 11, 12 show an interrelation between the results of evaluations of the temperature property, the light memory, the image flow and the roughness on the basis of the criterion for evaluation described in the foregoing.

In each samples of the photosensitive member, the hydrogen content is 10–30 atomic %.

FIG. 10 shows a relation between the temperature property and the characteristic energy (Eu) of the exponential function tail.

FIG. 11 shows an interrelation between the localization state density (D.O.S.) and the light memory.

FIG. 12 shows an interrelation between the localization state density (D.O.S.) and the image flow.

Figure 13:
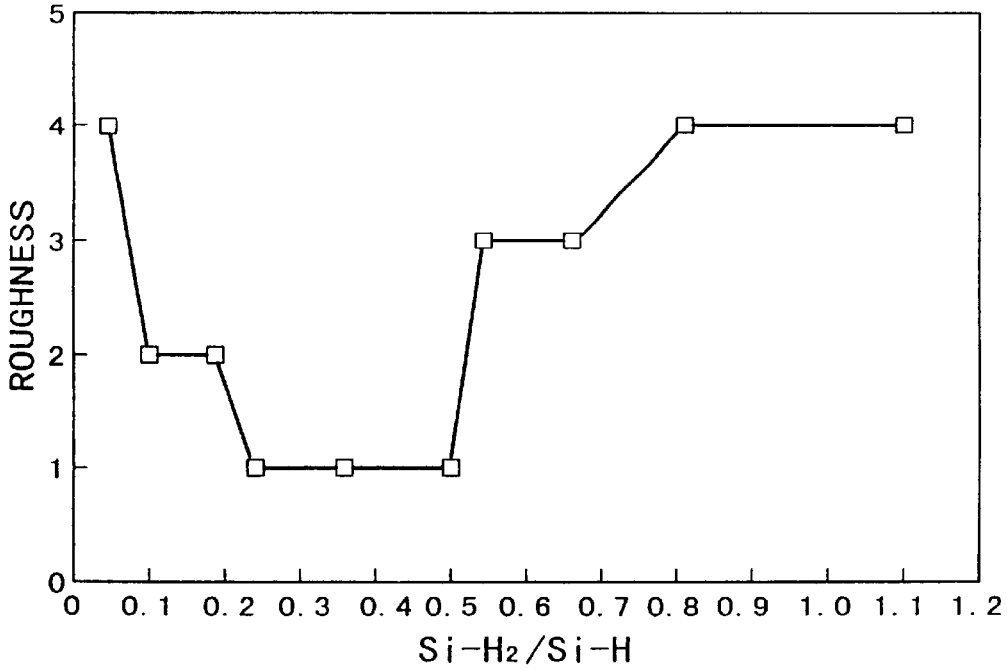
FIG. 13 is a graph showing the relationship between a ratio of Si—H2 bond and Si—H bond in the photoconductive layer of the amorphous silicon photosensitive member and an image roughness.
Figure 14:
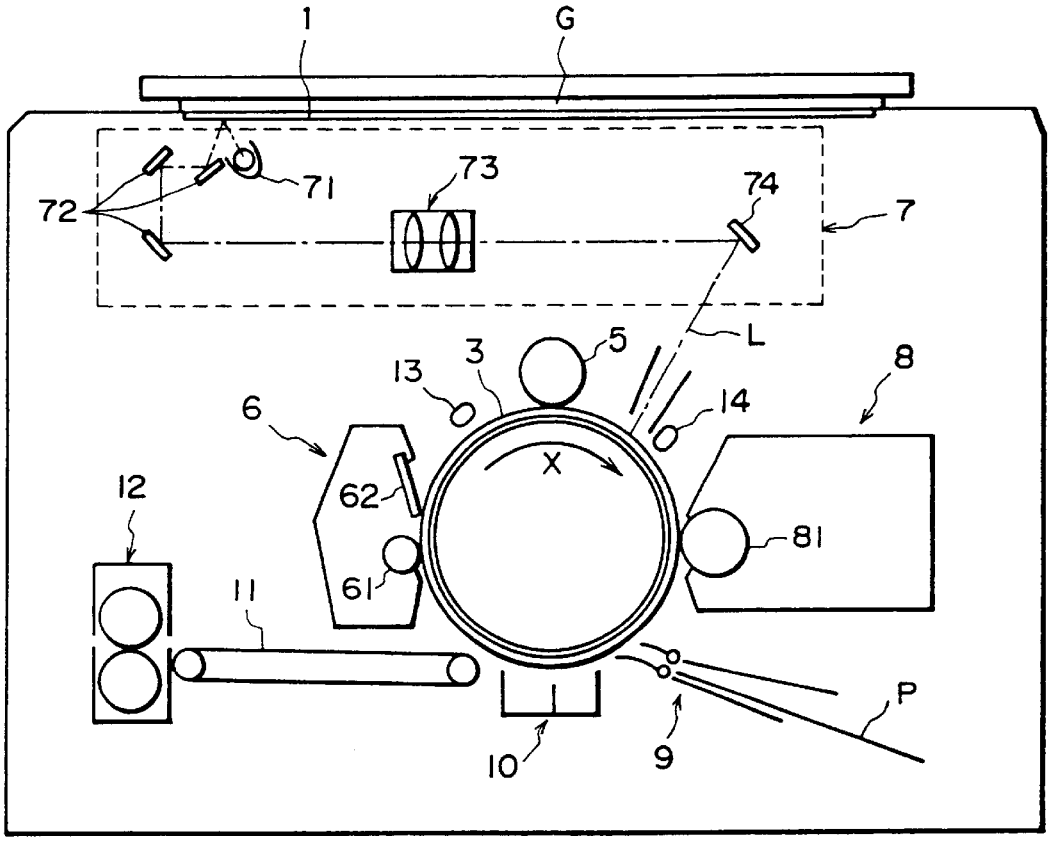
FIG. 14 PRIOR ART
FIG. 14 is a schematic illustration of an example of a conventional image forming apparatus.

FIG. 13 shows an interrelation between the Si-H2/Si-H ratio and the roughness.

As will be understood from FIGS. 10–13, the a-Si photosensitive member having a characteristic energy (Eu) of the exponential function tail provided by the sub-band-gap light absorption of 50–60 meV, the localization state density (D.O.S.) of $1\times10^{14}$–$1\times10^{16}$ $cm^3$ and the hydrogen bond ratio (Si-H2/Si-H ratio) of 0.2–0.5, exhibits the good electrophotographic property.

In this embodiment, various photosensitive members were produced with different conditions, mixing ratio of the $SiH_4$ and the $CH_4$ in the surface layer, and the electric discharging power and so on.

In the foregoing, the a-Si film was formed on the glass substrate and the Si wafer under the conditions for the photoconductive layer 33 (for example, FIG. 3(*c*)). Similarly, samples of the surface layer 34 (for example, FIG. 3(*c*)) were produced, and the resistance values were measured using a comb-like electrode. For the measurement of the resistance value, MΩ tester available from HIOKI was used while applying a voltage of 250–1 kV.

Samples of the surface layers were incorporated in the image forming apparatus, and the becoming apparatus was left under the ambience of 20° C., 10% RH for at least 72 hours to stabilize the ambience in the image forming apparatus. Then, the charging property and the potential retentivity were evaluated.

The resistance values of the photosensitive member samples and the withstand voltage were measured (critical voltage of the dielectric breakdown).

Furthermore, durability test for 50,000 sheets was carried out, and then, 100 continuous image formations were carried out from solid black, halftone chart and a transfer material, and the pin hole leakage from a fine drawback on the photosensitive member surface was evaluated.

FIG. 9 shows the results, from which it is understood that resistance value of the surface layer is preferably $1\times10^{10}$–$5\times10^{15}$ Ωcm since then electrical property such as the charge retentivity, the charging efficiency and the potential retentivity, and the pin hole leakage can be avoided. Further preferably, it is $5\times10^{12}$–$5\times10^{14}$ Ωcm.

(Embodiment 3)

In this embodiment, the properties of the electrophotographic photosensitive member according to the present invention will be described similarly to Embodiment 2. In this embodiment, use is made of an apparatus shown in FIG. 4 which is a film forming apparatus for the electrophotographic photosensitive member for the image forming apparatus using VH F-PCVD method, and an a-Si photosensitive member comprising a charge injection blocking layer, a photoconductive layer and a surface layer is produced on a aluminum cylinder which has been machined and washed, under that conditions shown in Table 2.

TABLE 2

| | injection blocking layer | photocon layer | surface layer |
|---|---|---|---|
| gas amount and rate | | | |
| $SiH_4$ [SCCM] | 150 | 200 | |
| $SiF_4$ [SCCM] | 5 | 3 | |
| $H_2$ [SCCM] | 500 | 800 | 450 |
| $B_2H_6$ [PPM] (to $SiH_4$) | 1500 | 3 | |
| NO [SCCM] | 10 | | |
| $CH_4$ [SCCM] | 5 | | 0 - 200 - 200 |
| $CF_4$ [SCCM] | | | (0 - 300 - 300) |
| support temp. [° C.] | 300 | 300 | 250 |
| pressure [Pa] | 4 | 1.3 | 2.7 |
| Power [W] | 200 | 600 | 800 |
| Thick [$\mu$m] | 2 | 30 | 0.5 |

Additionally, various photosensitive members were produced with different mixing ratio of $SiH_4$ and $H_2$ of the photoconductive layer and electric discharging power, and the 8similar experiments to Embodiment 2 were carried out.

In addition, an a-C:H photosensitive member having a surface layer not using $CF_4$ was produced.

On the other hand, similarly to Embodiment 2, a sample photosensitive member in which an a-si film having a thickness of approx. 1 μm accumulated on a glass substrate (Corning 7059) and a Si wafer placed on a cylindrical sample holder under the conditions of the photoconductive layer. An A1 comb-like electrode is deposited by evaporation on the accumulated film on the glass substrate, and the characteristic energy (Eu) of exponential function tail and the localization state density (D.O.S.) were measured by CPM ConstantPhotOcurrentMethod (constant photocurrent method)), and the contained hydrogen in the accumulated film on the Si wafer was measured by FT-IR (Fourier transformation infrared absorption).

Similarly to Embodiment 2, the a-Si photosensitive member having the characteristic energy (Fu) of the exponential function tail of 50–60 meV, the localization state density (D.O.S.) of $1\times10^{14}$–$1\times10^{16}$ $cm^{-3}$, exhibits good electrophotographic properties.

As a result of experiments similar to Embodiment 2, it has been found that resistance value of the surface layer of the photosensitive member is preferably $1\times10^{10}$–$5\times10^{15}$ Ωcm, similarly to Embodiment 2. Further preferably, it is $1\times10^{12}$–$1\times10^{14}$ Ωcm.

(Embodiment 4)

In the embodiments below, durability evaluation or the like as carried out for an image forming apparatus provided with a CLN charging member and an electrophotographic photosensitive member in which the properties are controlled in various ways, and the advantageous effects will be described.

In this embodiment, the sponge layer 21*b* constituting the charging member 21 was provided by foam-molding of EPDM in which kneaded carbon black and foam material are dispersed. A core metal 21*a* is inserted in the sponge layer 21*b,* and the sponge layer 21*b* was abraded into a predetermined dimension.

The average pore size of the sponge layer 21*b* of the CLN charging member of the present invention was 100 μm, and the volume resistivity thereof was approx. $3\times10^5$ Ωcm. In this embodiment the CLN charging member 21 has a hardness of 30°.

Additionally, other CLN charging members 21 having different pore sizes was prepared by adjusting the kneading ratio of the carbon black and the foam material, by using rubicelle (tradename, available from TOYO POLYMER KABUSHIKI KAISHA (KABUSHIKI KAISHA)) which is a polyurethane foam having a very small pore size such as 20 μm.

The preparation was made for 20 μm, 50 μm, 100 μm, 200 μm, 400 μm, 500 μm, 600 μm and 800 μm as the average pore size (diameter).

The preparation was made for $6\times10^3$ Ωcm, $2\times10^4$ Ωm, $3\times10^5$ Ωcm, $7\times10^7$ Ωcm, $1\times10^9$ Ωcm, $3\times10^{12}$ Ωcm, $1\times10^{13}$ Ωcm as the volume resistivity. The hardnesses are substantially the same.

The photosensitive members 3 in this embodiment were a-Si photosensitive member and were produced in the same manner as in Embodiment 2, and more specifically, the D.O.S. was $4\times10^{15}$ $cm^{-3}$, the Eu was 53 meV, and the resistance of the surface layer was $5\times10^{13}$ Ωcm.

They are incorporated in the image forming apparatus of FIG. 1 similarly to Embodiment 1, and the applied voltage to the photosensitive member 3, the exposure amount, the dark potential and the light potential were adjusted. The process speed of the photosensitive member 3 is 300 mm/s.

The surface of the CLN charging member 21 was coated with charging performance enhancing power, more specifically, ZnO powder having a particle size sufficiently smaller than that of a classified toner, and the excessive powder was removed. It was rotatable and is driven by a driving system (unshown).

The CLN charging member 21 is pressed against the photosensitive member 3, and a roller was used to provide a contact nip width of 6 mm relative to the photosensitive member 3.

During the durability test, the consumption of the charging-promotion particles were checked periodically, and the ZnO particle were supplied corresponding the consumption. The CLN charging member 21 was rotated counterdirectionally relative to the photosensitive member 3 at a peripheral speed of 70 mm/s.

The average particle size of the toner was 6 μm.

Brushing durability tests were carried out for 200,000 sheets under the ambience of N/N (25° C., 45% RH), for the image forming apparatus provided with the cleaning and charging member 21 having the above-described pore size and the volume resistivity.

Here, the durability sheet processing run tests were carried out using TC-A1 (Canon test chart FY9-9045-000), and several sample images were produced for each test chart. Additionally, the evaluations were made as to the image defect such as the defective cleaning, the light memory, the image flow, the white spot, and the black spot. The evaluation method was the same as with Embodiment 2.

Table 3 shows the results of evaluations as to the CLN charging member 21 and the photosensitive member 3 before and after the durability run. In the table:

E: excellent (the charging property is maintained a very good, and the defective cleaning level including the fog is well maintained and the image flow lever is maintained: rank 5

G: good (good image quality charging properties are maintained more in a good state, and the rank change of the defective cleaning level on the image is not more than 1: rank 4

F: the image quality is as with a conventional apparatus (the charging property retention and the charging property retention are equivalent to the conventional level:

Rank 3-1 (discriminated on the basis of the defective cleaning level).

TABLE 3

| Resist. ϕ | 20 | 50 | 100 | 200 | 400 | 500 | 600 | 800 |
|---|---|---|---|---|---|---|---|---|
| $6\times10^3$ | G | G | G | G | G | G | F | F |
| $2\times10^4$ | E | E | E | E | E | G | F | F |
| $3\times10^5$ | E | E | E | E | E | E | G | F |
| $7\times10^7$ | E | E | E | E | E | E | G | G |
| $1\times10^9$ | E | E | E | E | E | E | G | G |
| $3\times10^{12}$ | E | E | E | E | G | G | F | F |
| $1\times10^{13}$ | G | G | G | G | G | G–F | F | F |

Unit: Resistivity = Ohm · cm
ϕ = microns
Hardness: approx. 30

Then, the hardness of the CLN charging member 21 was changed, and the tests and the evaluations were carried out. The volume resistivity of the CLN charging member 21 of was $3\times10^5$ Ωcm–$5\times10^7$ Ωcm.

TABLE 4

| Hard. ϕ | 20 | 50 | 100 | 200 | 400 | 500 | 600 | 800 |
|---|---|---|---|---|---|---|---|---|
| 10 | G | G | G | G | G | F | F | F |
| 20 | E | E | E | E | E–G | G–F | F | F |
| 30 | E | E | E | E | E | E | G | G |
| 50 | E | E | E | E | E | E | G | G |
| 60 | E | E | E | E | E | E | G | G |
| 70 | E | E | E | E | E | E | G | G |
| 75 | F | G–F | G | G | G | G | G | F |

Unit: Hardness = degree
ϕ-microns
Resistivity: approx. $3\times10^5$–$5\times10^7$ Ohm · cm The CLN charging member 21 was rotated counterdirectionally at a speed of) 70 mm/s relative to the photosensitive member 3 similarly to the foregoing, and in addition, with different relative speed.

The peripheral speed of the CLN charging member 21 is determined so as to provide a predetermined relative speed relative to the photosensitive member 3, by which the contact of the CLN charging member 21 to the photosensitive member 3 becomes uniform, and the scraping of the untransferred toner in the cleaning is more effective.

The direction of the driving may be codirectional relative to the rotation of the photosensitive member 3 at the contact nip between the photosensitive member 3 and the CLN charging member 21, and even in that case, the properties of the CLN charging member 21 were good.

Good results were confirmed both in the use of one component toner or to component toner (containing toner carrier, for example).

As for the charging-promotion particle, the toner particles used as the developer by the developing device of the image forming apparatus may replace the ZnO particles, and the similar results were confirmed in such a case.

(Embodiment 5)

In this embodiment, the CLN charging member 21 and the photosensitive member 3 were incorporated in the image forming apparatus of FIG. 1, similarly to Embodiment 4, and the tests and the variations were carried out similarly to Embodiment 3. The CLN charging member 21 was rotated counterdirectionally relative to the peripheral movement of the photosensitive member 3 at the peripheral speed of 70 mm/s, similarly to the foregoing embodiments.

As shown in FIG. 6, the charging and cleaning device 2 of this embodiment further comprises particle supplying means 23 and a blade 22 at a position downstream of the particle supplying means 23 with respect to the rotational direction of the CLN charging member 21.

The evaluations of the tests of this embodiment were good.

After the durability run, the CLN charging member 21 was taken out of the image forming apparatus and was inspected, no reduction or localization of the charging-promotion particles is not recognized.

It is considered that CLN charging member 21 can be maintained in a good state by the combination in synergism of the function of the particle supplying means 23 supplying the charging-promotion particles to the surface of the CLN charging member 21 and the function of the blade 22 uniforming a proper amount of the particles on the CLN charging member 21 along the axial direction.

A doctor roller 24 is usable as described in Embodiment 1 in addition to the blade 22 for removal and/or uniformalization of the particles including the particles for the charging performance enhancing on the CLN charging member 21.

A plurality of such members may be provided in one image forming apparatus. For example, before and after the position where the particle supplying means 23 supplies the particles to the CLN charging member 21, a particle removing/uniforming mechanism such as the above described blade 22 and/or the doctor roller 23 may be provided, by which the foreign matter removed from the photosensitive member 3 can be more efficiently removed from the CLN charging member 21, which is advantageous for the subsequent cleaning and charging process.

(Embodiment 6)

In this embodiment, similarly to Embodiment 3, the a-Si photosensitive member is produced, wherein the D.O.S. is $2\times10^{15}$ $cm^{-3}$, Eu is 52 meV, and the surface layer 34 is of amorphous carbon (a-C:H), and the resistance is $4\times10^{13}$ Ωcm.

Except for the photosensitive member 3, the structures of the CLN charging member 21 and the charging-promotion particles are evaluated in the same manner as with Embodiment 4. In this embodiment, similarly to Embodiment 4, the CLN charging member 21 was rotated at the peripheral speed of 70 mm/s counterdirectionally relative to the photosensitive member 3. The results after the durability run are shown in tables 5 and 6.

TABLE 5

| Resist. ϕ | 20 | 50 | 100 | 200 | 400 | 500 | 600 | 800 |
|---|---|---|---|---|---|---|---|---|
| $6\times10^3$ | G | G | G | G | G | G | F | F |
| $2\times10^4$ | E | E | E | E | E | G | G–F | F |
| $3\times10^5$ | E | E | E | E | E | E | G | F |
| $7\times10^7$ | E | E | E | E | E | E | G | G |
| $1\times10^9$ | E | E | E | E | E | E | G | G |
| $3\times10^{12}$ | E | E | E | E | E–G | G | G–F | F |
| $1\times10^{13}$ | G | G | G | G | G | G | G–F | F |

Unit: volume resistivity (Ωcm) college and pore size ϕ (μm)
Hardness is approx. 30°.

TABLE 6

| Hard. ϕ | 20 | 50 | 100 | 200 | 400 | 500 | 600 | 800 |
|---|---|---|---|---|---|---|---|---|
| 10 | E–G | E–G | E–G | G | G | G–F | G–F | F |
| 20 | E | E | E | E | E | G–F | G–F | F |
| 30 | E | E | E | E | E | E | G | G |
| 50 | E | E | E | E | E | E | G | G |
| 60 | E | E | E | E | E | E | G | G |
| 70 | E | E | E | E | E | E | G | G |
| 75 | G–F | G–F | E–G | E–G | E–G | E–G | G | G–F |

Unit: harness (degree), and pore size ϕ (μm).
Volume resistivity was $3\times10^5$ Ωcm–$5\times10^7$ cm As in this embodiment, by the use of the surface layer of an a-C:H, the adaptability to the hardness of the CLN charging member 21 and to the pore size on the surface thereof are enhanced. More particularly, even when the hardness of the CLN charging member 21 is low, the fact that friction is low is effective to suppress the damage due to the rubbing of the particles and the sponge layer 21*b* per se with the photosensitive member 3.

On the other hand, the hardness of the sponge layer 21*b* is high, the surface layer of the photosensitive member 3 has a high hardness so that friction with the CLN charging member 21 is decreased, so that damage of the CLN charging member 21 is suppressed.

Furthermore, according to this embodiment, the load required for driving the CLN charging member 21 is used, wearing (particularly when low hardness CLN charging member is used) is reduced.

(Embodiment 7)

In this embodiment, the photosensitive member 3 was prepared in the same manner as in Embodiment 2, similarly to Embodiment 6. However, in this embodiment, in the preparation of the surface layer 34 of the photosensitive member, the source material gas contains gas comprising fluorine, and the discharging power and the internal pressure were adjusted correspondingly.

The photosensitive member 3 is an a-Si photosensitive member, and the photoconductive layer 33 boards of the same as with Embodiment 6, and the surface layer was of amorphous carbon (a-C:H:F) including fluorine, and the registers thereof is $8\times10^{14}$ Ωcm. By the function of the fluorine, the fiction of the photosensitive member surface is low.

According to Embodiment 8 all of this environment, the photosensitive member is provided with a surface protection layer (overcoating layer, OLC) having a charge injection property, on the photosensitive layer (organic photoconductive layer (OPC)).

Referring to FIG. 3(*f*), a description of another embodiment now will be made.

On a base which is an aluminum cylinder, 5% methanol solution of alkoxy methyl Nylon is applied through a dipping method to form a lining layer (intermediate layer) having a film thickness 1 μm.

Subsequently, 10 parts (parts by wt.) of oxytitanium phthalocyanine pigment, 8 parts of polyvinyl butyral and 50 parts of cyclohexanone a mixed and dispersed for 20 hours by a sand mill apparatus using 100 parts of glass beads having the diameter of 1 mm. To the dispersing liquid, 70–120 parts of methyl ethyl ketone was added, and was applied on the lining layer, and it was dried at 100° C. for 5 min. to form a charge generating layer 37 having a thickness of 0.2 μm.

10 parts of styryl compound, 10 parts of bisphenol type polybarbonate are dissolved in 65 parts of monochlorobenzene. The liquid was applied on the charge generating layer 37 through dipping method, and was dried by hot air at 120° C. for 60 min. to form a charge transfer layer 38 having a thickness of 20 μm.

A charge injection type surface protection layer (OCL) 34' having a thickness of 1.0 μm was formed on the charge transfer layer 38. In this embodiment, the OCL is prepared in this manner.

(A) 100 parts of high melting point polyethylene terephthalate provided by terephthalic acid as the acid component and ethylene glycol as the glycol component, having a limitating viscosity of 0.70 dl/g, melting point of 258 degree, a glass transition temperature of 70° C. (the glass transition temperature was measured at a temperature rise speed of 10° C./min using a differential calorimeter as to a 5 mg. of measured sample prepared by melting the sample polyester resin material at 280° C. and quenching it by ice water of 0° C., and (B) epoxy resin material (epoxy equivalent is 160, aromatic ester type, tradename is Epikote 190P, available from YUKA SHELL EPOXY), are dissolved in 100 ml of mixed liquid of phenol and tetrachloroethane (1:1).

Into the liquid thus prepared, 60% by weight of SnO2 powder was mixed, as charge retaining powder. The resistance value of the OCL layer is adjustable by selection of the resin material and/or the amount of the charger retaining powder.

Then, (C) 3 parts of were added, thus producing resin material composition liquid.

It was throughout by 2 kW high-pressure mercury lamp (30 W/cm) placed 20 cm away at 130° C. for 8 sec.

The resistance of the OCL of this embodiment was $8\times10^{13}$ Ωcm.

The CLN charging member 21 has the same volume resistivity, hardness and pore size as with Embodiment 3, and they were incorporated in the image forming apparatus of FIG. 1. The process speed (peripheral speed of the photosensitive member 3) was 150 mm/sec, the conditions such as the applied voltage to the CLN charging member 21 or the like was adjusted such that dark potential of the surface of the photosensitive member 3 was −700 V, and that potential (image portion) after the exposure by the image signal application was −130 V.

The CLN charging member 21 was contacted to the photosensitive member 3 with the nip width of 6 mm, and was driven at the peripheral speed of 70 mm. Similarly to Embodiment 4, the charging-promotion particle supplying means 23 and the blade 22 were provided around the CLN charging member 21. The charging-promotion particle are of ZnO, similarly to Embodiment 3.

That, durability run tests were carried out for 10,000 sheets under the N/N ambience cognition, and the results have been confirmed.

More particularly, in this embodiment, the image quality and the contact of the CLN charging member 21 to the photosensitive member 3 were maintained even after the test. Additionally, known damage or wearing of the CLN charging member 21 was recognized. Moreover, no damage or scraping of the surface of the photosensitive member, which will adversely influence the image formation, was recognized even after the test.

According to this environment, the existence of the charging-promotion particles increases the effective contact area between the CLN charging member 21 and the photosensitive member 3, so that high efficiency of the charge injection is accomplished, and the flowability of the charging-promotion particles on the CLN charging member 21 is improved, and therefore, localized pressure is removed.

As described, the present invention is applicable to the OPC photosensitive member.

The present invention is not limited to the case wherein the CLN charging member 21 and then electrophotographic photosensitive member 3 are fixed in the image forming apparatus, it is usable with a process cartridge which contains as a unit the CLN charging member 21 and the photosensitive member 3 in the form of cartridges which is detachably mountable to the main assembly of the image forming apparatus. The cartridge may contain as a unit the CLN charging member 21, the developing device 8 having the developer carrying member 81, the electrophotographic photosensitive member 3 in the form of cartridge which is detachably mountable to the main assembly of the image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing an electrostatic image;

developing means for developing the electrostatic image on said image bearing member with toner into a toner image;

transfer means for transferring the toner image onto a transfer material;

charging and cleaning means for removing residual toner after image transfer from said image bearing member and for charging said image bearing member;

wherein said charging and cleaning means includes a rotatable member which has an electroconductive foam having cells and an electroconductive particle layer formed on said electroconductive foam and which is rotatable while rubbing with said image bearing member with the electroconductive particle layer therebetween.

2. An apparatus according to claim 1, wherein the electroconductive particles comprises zinc oxide.

3. An apparatus according to claim 1, wherein a depth of the cells in the surface of said rotatable member is not less than a radius of the electroconductive particles.

4. An apparatus according to claim 1, wherein a diameter of the cell in the surface of said rotatable member is not more than 500 microns.

5. An apparatus according to claim 1, wherein said rotatable member has an Asker-C hardness of not less than 15 and not more than 70 degrees.

6. An apparatus according to claim 5, wherein the hardness is not less than 20 and not more than 60 degrees.

7. An apparatus according to claim 1, wherein said electroconductive foam has a resistivity of not less than $10^3$ and not more than $10^{12}$ Ohm.cm.

8. An apparatus according to claim 7, wherein the resistivity is not less than $10^5$ and not more than $10^9$ Ohm.cm.

9. An apparatus according to claim 1, wherein said charging and cleaning means has a collecting member for collecting the toner from said rotatable member.

* * * * *

UNITED STATES PATENT AND TRADEMARK OFFICE

CERTIFICATE OF CORRECTION

PATENT NO. : 6,272,301 B1
DATED : August 7, 2001
INVENTOR(S) : Masaya Kawada et al.

It is certified that error appears in the above-identified patent and that said Letters Patent is hereby corrected as shown below:

Column 3,
Line 45, "has" should read -- as --; and
Line 53, "id" should read -- is --.

Column 4,
Line 46, "blurrness" should read -- blurriness --.

Column 5,
Line 55, "atom" should read -- atoms --.

Column 6,
Line 1, "SHO-62-168616" should read -- SHO-62-168161 --;
Line 3, "atom," should read -- atoms, --;
Line 27, "a" (first occurrence) should be deleted;
Line 28, "the" should be deleted; and
Line 61, "susceptivility" should read -- susceptibility --.

Column 7,
Line 18, "non-contact" should read -- noncontact --.

Figure 8A:
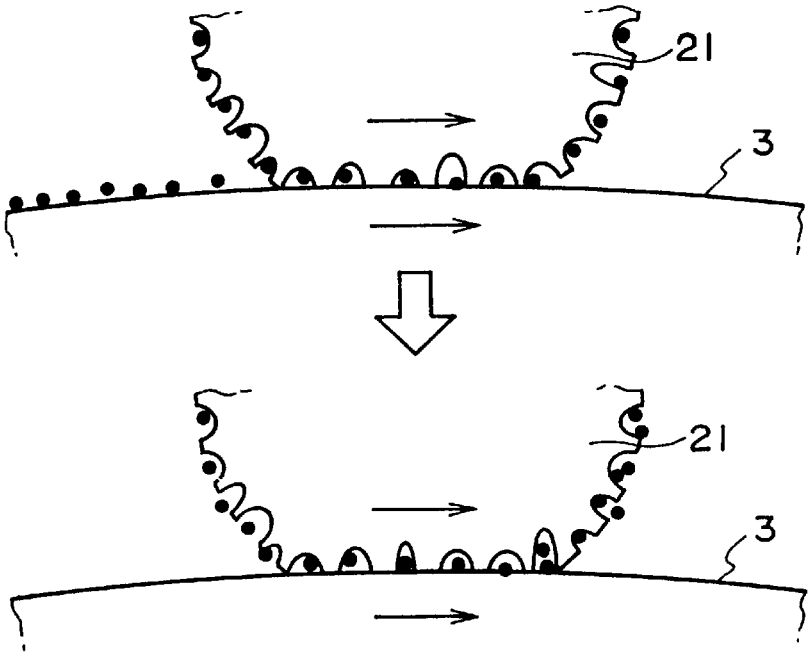
FIG. 8 is a schematic view showing retention of the particles by the CLN charging member when the contact surfaces of the CLN charging member and the photosensitive member move in the same direction and in the opposite direction.
Figure 8B:
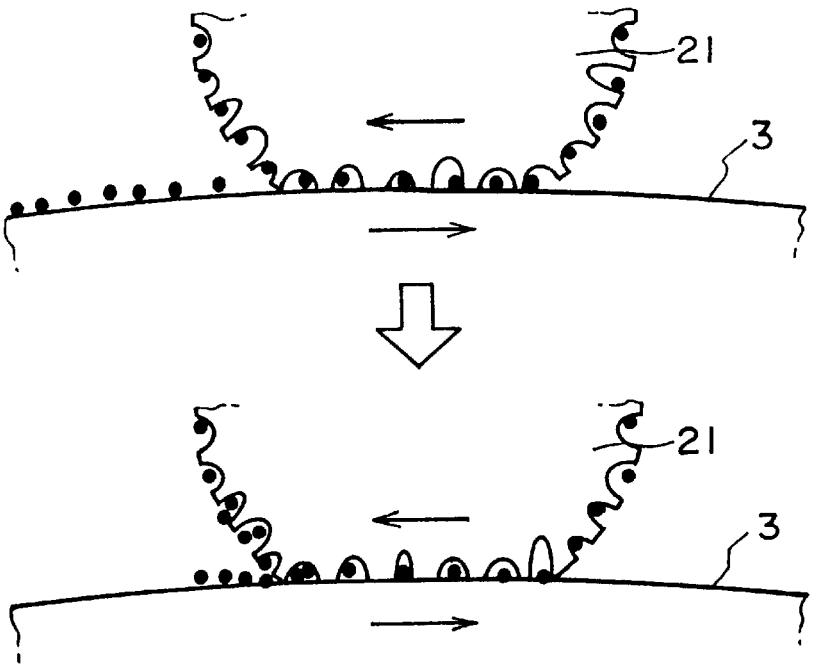

Column 8,
Line 35, "FIG. 3" should read -- FIG. 3 consisting of FIG. 3(a) through 3(f) --; and
Line 54, "FIG. 8" should read -- FIG. 8 consisting of FIGS. 8(a) and 8(a) and 8(b) --.

Column 9,
Line 42, "a" should read -- G --.

Column 11,
Line 3, "sable" should read -- usable -- ; and
Line 33, "21h," should read -- 21b, --.

Column 12,
Line 39, "cleaning" (first occurrence) should be deleted.

Column 13,
Line 3, "cLN" should read -- CLN --.

Column 15,
Line 16, "cycloheXanedimetylol" should read -- cyclohexanedimetylol --;
Line 32, "material" should read -- materials --; and
Line 43, "$SnO_2$" should read -- SnO2 --.

UNITED STATES PATENT AND TRADEMARK OFFICE

CERTIFICATE OF CORRECTION

PATENT NO. : 6,272,301 B1
DATED : August 7, 2001
INVENTOR(S) : Masaya Kawada et al.

It is certified that error appears in the above-identified patent and that said Letters Patent is hereby corrected as shown below:

Column 16,
Line 30, "FIG. 3," should read -- FIG. 3 --.

Column 17,
Line 31, "provided" should read -- provide --.

Column 18,
Line 39, "atom" should read -- atoms --; and
Line 52, "atom" should read -- atoms -- .

Column 19,
Line 7, "the" should read -- of the --;
Line 10, "atom" (both occurrences) should read -- atoms --;
Line 11, "atom" should read -- atoms --;
Line 47, "and a" should read -- and an --;
Line 50, "amorphous" should read -- an amourphous --; and
Line 52, "nitrogen" should read -- or nitrogen --.

Column 20,
Line 7, "atom" should read -- atoms --.

Column 21,
Line 26, "1njection" should read -- injection --.

Column 24,
Line 36, "charged" should read -- charge --;
Line 41, "comprising" should read -- comprise --;
Line 42, "are" should read -- a --;
Line 55 "are" should read -- is -- ; and
Line 67, "(FIG. 21)," should read -- (FIG. 2), --.

Column 25,
Line 24, "directions" should read -- direction --.

Column 27,
Line 25, "25+2°C.," should read -- 25±2°C., -- and "RG" should read -- RH --;
Line 27, "15+2°C.," should read -- 25±2°C., --;
Line 31, "based" should read -- are based --;
Line 35, "(non-image" should read -- (nonimage --; and
Line 57, "good." should read -- good: --.

UNITED STATES PATENT AND TRADEMARK OFFICE

CERTIFICATE OF CORRECTION

PATENT NO. : 6,272,301 B1
DATED : August 7, 2001
INVENTOR(S) : Masaya Kawada et al.

It is certified that error appears in the above-identified patent and that said Letters Patent is hereby corrected as shown below:

Column 29,
Line 21, "Practically" should read -- 4. Practically --;
Line 29, "Tc-A1" should read -- TC-A1 --; and
Line 48, "samples" should read -- sample --.

Column 31,
Line 29, "as" should read -- was --.

Column 32,
Line 39, "a very good" should read -- very well --.

Column 33,
Line 3, "of" (second occurrence) should be deleted; and
Line 20, "of)" should read -- of --.

Column 36,
Line 10, "were" should read -- water --.

Signed and Sealed this

Twenty-eighth Day of May, 2002

*Attest:*

*Attesting Officer*

JAMES E. ROGAN
*Director of the United States Patent and Trademark Office*